US008682629B2

(12) United States Patent
Montaron et al.

(10) Patent No.: US 8,682,629 B2
(45) Date of Patent: Mar. 25, 2014

(54) MULTI-PHASIC DYNAMIC KARST RESERVOIR NUMERICAL SIMULATOR

(75) Inventors: Bernard Andrë Montaron, Saint Marcel-Paulel (FR); Younes Jalali, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 303 days.

(21) Appl. No.: 13/094,431

(22) Filed: Apr. 26, 2011

(65) Prior Publication Data

US 2011/0295581 A1 Dec. 1, 2011

Related U.S. Application Data

(60) Provisional application No. 61/348,014, filed on May 25, 2010.

(51) Int. Cl.
*G06G 7/48* (2006.01)

(52) U.S. Cl.
USPC ..... 703/10

(58) Field of Classification Search
None
See application file for complete search history.

(56) References Cited

U.S. PATENT DOCUMENTS

2007/0001028 A1* 1/2007 Gysling ..... 239/318
2009/0306947 A1* 12/2009 Davidson ..... 703/2

OTHER PUBLICATIONS

Shen et al., Characterization and Preservation of Karst Netwroks in the Carbonate Reservoir Modeling, 2007, Society of Petroleum Engineers, pp. 1-8.*
Abreu et al., Operator Splitting for Three-Phase Flow in Heterogeneous Porous Media, Jul. 2009, Communications in Computational Physics, vol. 6 No. 1, pp. 72-84.*
Panfilov et al., Macrokinetic Model of the Trapping Process in Two-Phase Fluid Displacement in a Porous Medium, 1995, Fluid Dynamics, vol. 30 No. 3, pp. 409-417.*
Peng, Xiaolong, et al., "A New Darcy-Stokes Flow Model for Cavity-Fractured Reservoir"; SPE 106751, Society of Petroleum Engineers, presented at the 2007 SPE Production and Operations Symposium held in Oklahoma City, Oklahoma, USA, Mar. 31-Apr. 3, 2007; 7 pages.
Popov, P., et al., "Multiscale Methods for Modeling Fluid Flow Through Naturally Fractured Carbonate Karst Reservoirs"; SPE 110778, Society of Petroleum Engineers, presentated at the 2007 SPE Annual Technical conference and Exhibition held in Anaheim, California, USA, Nov. 11-14, 2007; 9 pages.

* cited by examiner

*Primary Examiner* — Omar Fernandez Rivas
*Assistant Examiner* — Bernard E Cothran
(74) *Attorney, Agent, or Firm* — Rodney Warfford; Colin Wier

(57) ABSTRACT

A multi-phasic dynamic reservoir simulator includes a reservoir model for a karst system comprising: a plurality of caves connected via at least one conduit, wherein the plurality of caves and the at least one conduit are filled with at least two types of fluids, an exit point for a fluid to leave the karst system and at least one entry point for a fluid to enter the karst system from a surrounding rock matrix, and a set of parameters defining volumes and distributions of the at least two types of fluids in the plurality of caves and the at least one conduit; and a program having instructions for causing a processor to simulate fluid flows in the reservoir model for the karst system.

22 Claims, 29 Drawing Sheets

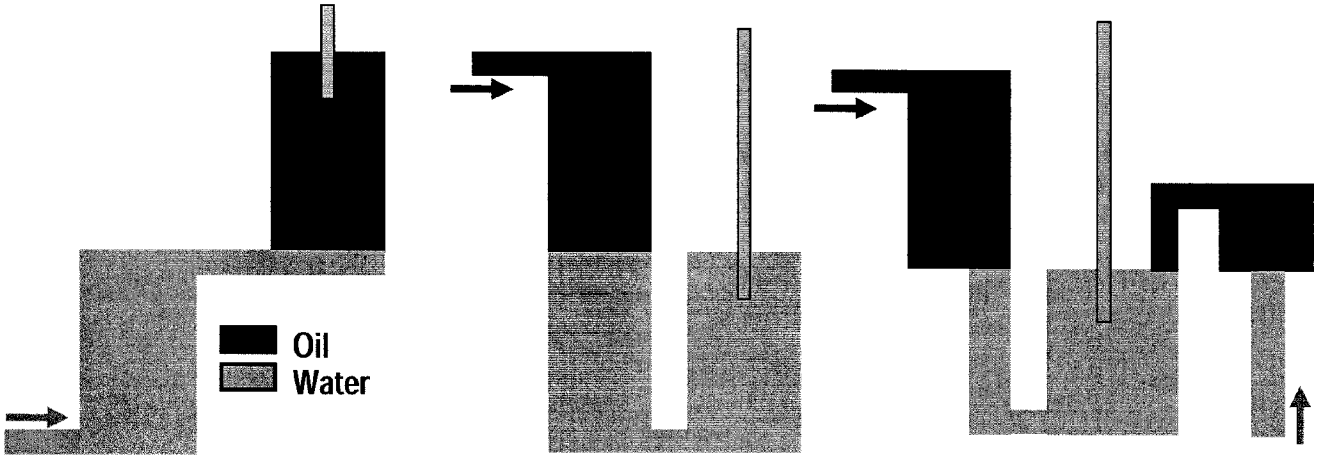
FIG. 3A
FIG. 3B
FIG. 3C
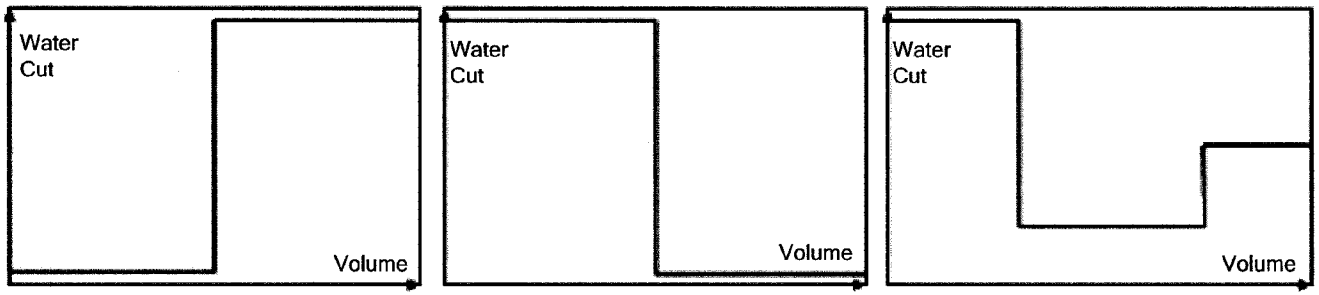
FIG. 3D
FIG. 3E
FIG. 3F

MULTI-PHASIC DYNAMIC KARST RESERVOIR NUMERICAL SIMULATOR

CROSS REFERENCE TO RELATED APPLICATIONS

This claims benefit of provisional application Ser. No. 61/348,014, filed on May 25, 2010, which is incorporated by reference in its entirety.

BACKGROUND OF INVENTION

1. Field of the Invention

This invention relates to geological structural modeling of subsurface rock formations, particularly subsurface formation comprising caves (i.e., karst systems).

2. Background Art

While hydrocarbon reservoirs are more often found in porous rocks, karst carbonate reservoirs are important in certain regions in the world, such as China, Middle East, and Russia. For example, the Tarim basin in China contains many oil-rich carbonate fields, in which the oil is contained in caves that formed after dissolution of carbonate rocks by water. The Tarim field is one of the five giant Chinese oilfields with the significant potential for oil production growth in the coming decades.

Unlike conventional porous rock reservoirs, karst systems comprise caves connected with various types of conduits, such as channels and fractures (see FIG. 1A). Therefore, while fluid flows in porous rocks are mostly affected by fluid viscosities and pressure differentials, fluid flows in karst systems are governed mostly by gravity and mass conservation, i.e. similar to open channel flows. Accordingly, conventional dynamic simulators (based on Darcy's law) for porous rocks cannot be directly applied to simulate karst systems.

Due to open channel flow and variable geometries of the caves and conduits, general oil-water contact (OWC) in the region often does not define the boundary of the oil and water. As shown in FIG. 1B, some of the water may be trapped in caves above the general OWC, while some oils may be trapped in caves below the general OWC.

Therefore, dynamic simulation of fluid flows that have been developed for conventional reservoirs based on porous rock models cannot be directly applied to karst systems. In order to simulate flow flows in karst systems, one would need new types of dynamic simulators.

Karst systems have been studied for some time by geologists, speleologists, hydrologists. Many publications covering geomorphological studies, karst creation mechanisms, and bi-phasic flow considerations exist, such as P. Popov et al., "*multiscale modeling and simulations of flows in naturally fractured karst reservoirs*," Communications in Computer Physics, 2009, Vol. 6, No. 1, pp. 162-184; and Xiaolong Peng et al., "*A New Darcy-Stokes Model for Cavity-Fractured Reservoirs,*" 2007, SPE 106751. These publications often concern single-phase flow models. In addition, many fresh water reservoirs have been exploited for potable water. Such water reservoirs are often contained in karst systems. The dynamic simulation of these water reservoirs involves two phases: water and air.

Although dynamic simulators for karst systems are known, there remains a need for better dynamic simulators for karst systems, including simulators for karst systems containing more than two phases.

SUMMARY OF INVENTION

One aspect of the invention relates to multi-phasic dynamic reservoir simulators. A multi-phasic dynamic reservoir simulator in accordance with one embodiment of the invention includes a reservoir model for a karst system comprising: a plurality of caves connected via at least one conduit, wherein the plurality of caves and the at least one conduit are filled with at least two types of fluids, an exit point for a fluid to leave the karst system and at least one entry point for a fluid to enter the karst system from a surrounding rock matrix, and a set of parameters defining volumes and distributions of the at least two types of fluids in the plurality of caves and the at least one conduit; and a program having instructions for causing a processor to simulate fluid flows in the reservoir model for the karst system.

Another aspect of the invention relates to methods for simulating fluid behavior in a karst system using a multi-phasic dynamic reservoir simulator. A method in accordance with one embodiment of the invention includes the steps of: constructing a reservoir model for the karst system, wherein the reservoir model comprises: a plurality of caves connected via at least one conduit, wherein the plurality of caves and the at least one conduit are filled with at least two types of fluids, an exit point for a fluid to leave the karst system and at least one entry point for a fluid to enter the karst system from a surrounding rock matrix, and a set of parameters defining volumes and distributions of the at least two types of fluids in the plurality of caves and the at least one conduit; and simulating fluid flows in the reservoir model for the karst system.

Other aspects and advantages of the invention will be apparent from the following description and the appended claims.

BRIEF DESCRIPTION OF DRAWINGS

FIGS. 3A-3C show simple model elements representing caves connected via conduits in accordance with one embodiment of the invention.

FIGS. 3D-3F show water cuts of produced fluids from the model shown in FIGS. 3A-3C, respectively.

DETAILED DESCRIPTION

Embodiments of the invention relate to multi-phasic dynamic reservoir numerical simulator systems for simulating fluid flows in karst systems. The simulator systems are capable of simulating dynamic fluid flows in the karst systems. In accordance with embodiments of the invention, the dynamic simulator systems may be designed to handle multi-phasic fluid flows, i.e., fluid flows including two, three, or more phases (e.g. water, oil, and gas). "Fluid" as used herein has its common meaning, i.e., a fluid can be a liquid or a gas. "Muti-phasic fluids" indicates fluids having at least two phases. Two non-mixable liquids would have two different phases.

In oilfield operations, it is sometimes necessary to deal with more than three phases, for example in the case of $CO_2$ injection in a deep karst oil reservoir, such as those encountered in Northwest China. In these situations, $CO_2$ may take two forms: gaseous or super-critical. In addition, $CO_2$ may partially dissolve in oil and/or water. Therefore, having simulators capable of handling multi-phases can be useful.

The dynamic simulators in accordance with embodiments of the invention may be applied to simulate or predict the production behaviors of karst reservoirs. In such applications, the dynamic simulators may be used to predict the fluid movements in the reservoirs and to suggest optimal well placements for better production. In addition, these dynamic simulators may be used to suggest how to enhance the production, for example, by gas injection.

In addition, one may use such dynamic simulators to solve the inverse problem—i.e., to simulate the actual production from wells to arrive at better understanding of the underground cave systems. For example, these simulators may be used to explain the observed production rates for water, oil, and gas, as a function of time. In solving the inverse problems, the karst model parameters may be varied in order to try to reproduce a given production curve. The parameters that can be varied may include, for example, the karst system geometry, the distribution of fluids, or other parameters. Therefore, simulators in accordance with embodiments of the invention can help an operator understand and interpret well testing and production results.

Figure 1B:
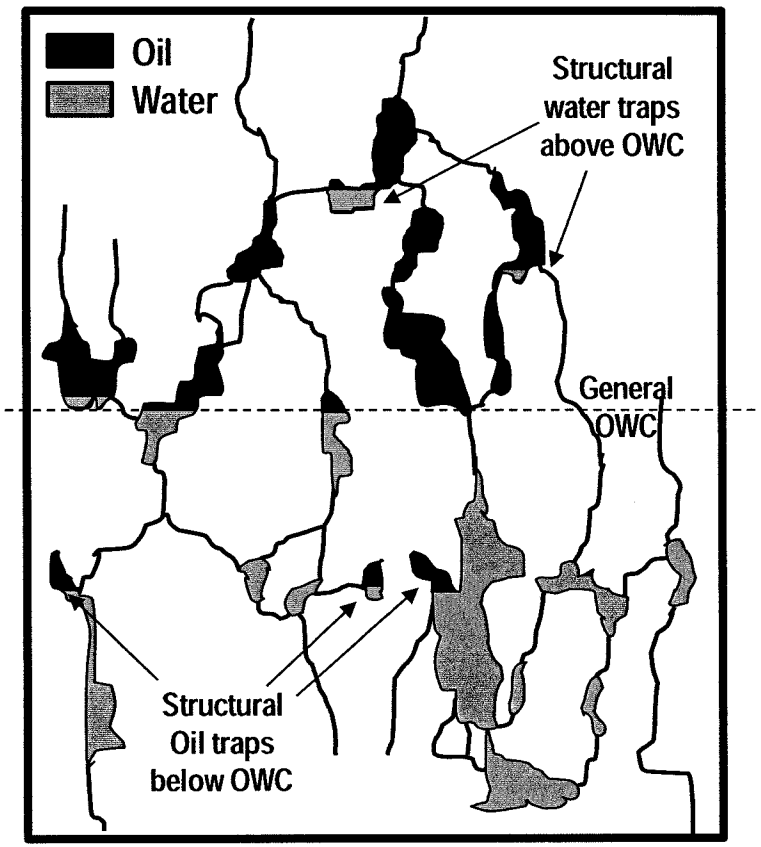
FIG. 1B shows a conventional karst system illustrating trapping of oil and water in various caves at various depths regardless of general oil-water contact in the area.
Figure 1A:
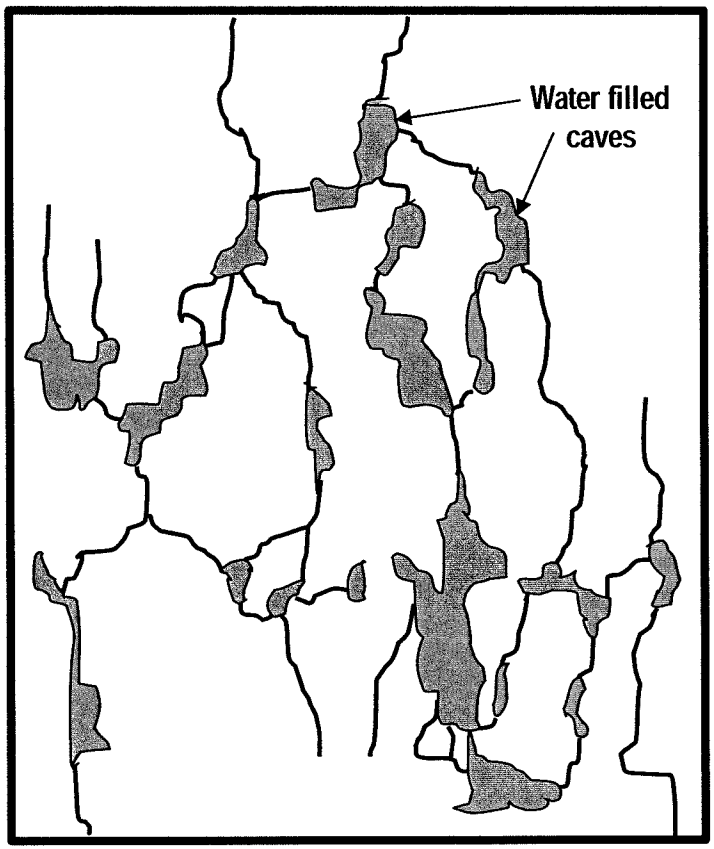
FIG. 1A shows a conventional karst system comprising multiple caves connected via channels or fractures.
Figure 2B:
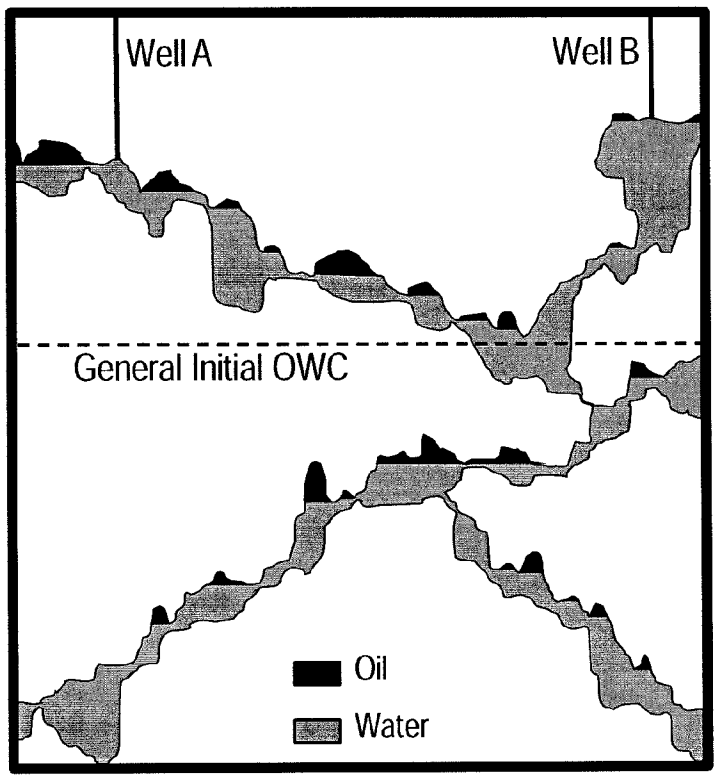
FIGS. 2A-2B shows production of oil from a karst system that can leave some oil behind.
Figure 2A:
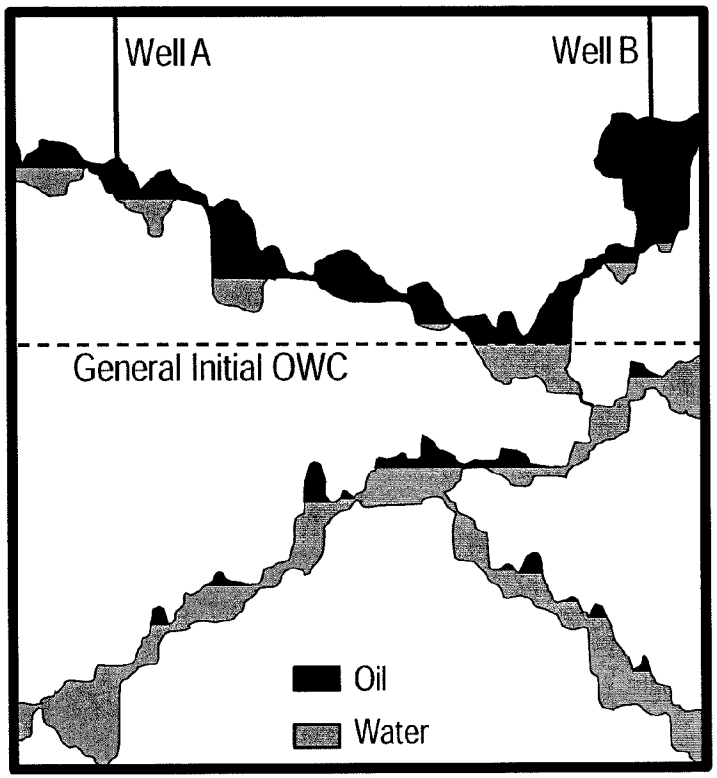

Furthermore, karst system dynamic simulators of the invention are capable of handling a very detailed and complex geomorphology of caves. Such simulators can also be used to predict recovery factors for hydrocarbons in karst systems. For example, as shown in FIG. 2A, two production wells, Well A and Well B, may be drilled in the karst system at locations shown. These two production wells will be able to produce most of the hydrocarbons in the system. However, not all hydrocarbons can be produced. As shown in FIG. 2B, oil and/or gas can be trapped in recessed pockets in the ceiling of caves and become non-producible.

In order to produce the trapped hydrocarbons, enhanced oil recovery (EOR), for example by gas injection, may be performed. In accordance with embodiments of the invention, EOR operations can be simulated with a multi-phasic system before the injection well is drilled. The simulation can be used to optimize the efficiency of EOR. For example, an injection well, Well C in FIG. 2C, may be drilled to a lower points than Well A and Well B. Then, gas (e.g., nitrogen or $CO_2$) may be injected into the reservoir. The injected gas would migrate upwards due to gravity effects and may flow into the recessed pockets to force the oil downwards and out of the traps, making it producible.

Figure 2C:
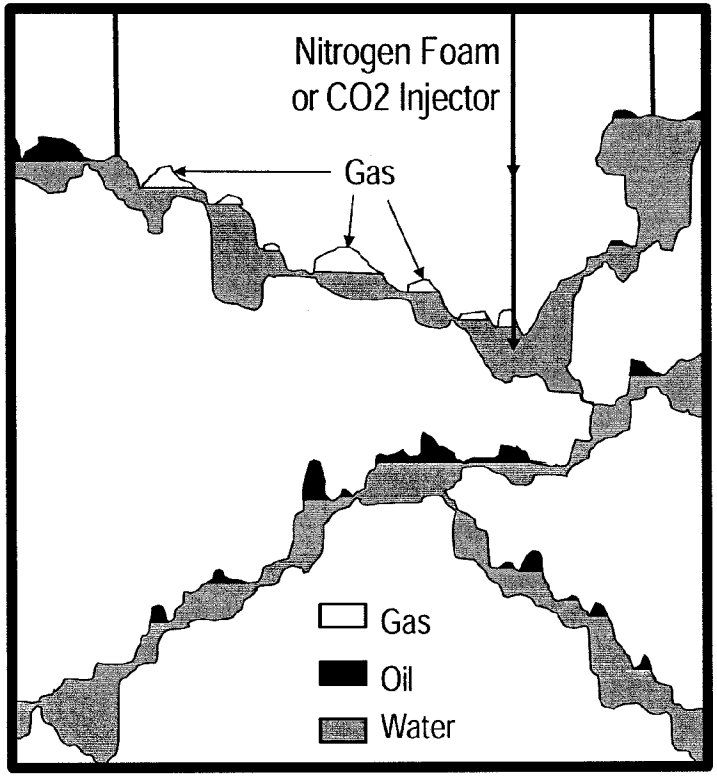
FIG. 2C shows that injection of gas can be used to enhance the recovery in accordance with one embodiment of the invention.

As illustrated in FIGS. 2A-2C, well placement of production wells and injection wells can be optimized with a simulator of the invention. The placements of these wells can be simulated by testing different well placement scenarios and predicting the production and recovery for each scenario. Being able to simulate the optimal placements of production wells can help the operator determine if the planned EOR operations are economical or not.

In accordance with embodiments of the invention, the simulation may include complex well trajectories and cave systems. For example one production well may be designed to be connected with several caves that are produced commingled.

As noted above, the initial distribution of various phases in a karst system may not be entirely correlated with the depth. For example, water may be trapped in higher caves and oil may be trapped in lower caves—i.e., both oil and water may be found at different depth levels in the system, regardless of the general OWC. The reservoirs may have been charged with oil from surrounding source rock above, below and laterally. While gravity would force most hydrocarbons to move upward in the connected carves and conduits, some carves may have ceilings that can trap hydrocarbons. That situation can even be more pronounced after the reservoir has been produced for some time. The level of water in the cave system goes up with time, replacing the produced oil, but oil can be left at lower levels trapped in cave ceilings or siphons.

The simulator can have various levels of complexities depending on the karst system models, and depending on the physical phenomena. In accordance with embodiments of the invention, a simple system may simulate multi-phasic flows in a model containing a series of tanks connected with conduits. Even with such a simple model, one can reproduce very complex production behaviors. Such a simulator may be adequate for optimizing production parameters in actual karst reservoir development.

In accordance with some embodiments of the invention, more complex karst simulation systems may take into account various factors, such as fractures, pipe-type conduits, permeable layers, and the slow exchange with a tight rock matrix surrounding the caves. Such complex systems may contain a wide range of time constants. Such a simulator can help understand and interpret well testing and production results.

FIGS. 3A-3F show examples that use simulation to interpret production data, based on an assumption that fluid flows in cave systems are basically free flows that have nothing to do with Darcy flows observed for porous media. Water, oil, and gas free flows in karst systems are similar to fluid flows in pipes or conduits of various shapes that have large enough diameters such that Darcy equation (which is based on fluid viscosities and pressure differentials) is not applicable. Instead, the dynamic behaviors in the karst systems are dominated by Bernoulli type flows where the principles of momentum, energy, and mass conservation, are sufficient. Another characteristic of these systems is that wherever the local flow rate is slow enough, the flow is actually dominated by gravity, i.e. by buoyancy forces.

FIG. 3A shows a simple system having two caves connected with a pipe. A production well is connected to the upper cave. Before the production starts, gravity forces oil and/or gas into the upper portions of the system, while water remains in the lower portion. Production from such a system will result in a production curve shown in FIG. 3D, which shows that the production is mostly hydrocarbons initially, followed by the production of water when the hydrocarbons have been exhausted.

FIG. 3B shows a system with a little more complexity. In this system, the two caves are connected at their lower portions, and a production well is located in the cave that has water initially. FIG. 3E shows the production data of such a system, which shows that the initial production is mostly water, and hydrocarbons are produced only after the water has been exhausted.

FIG. 3C shows a system with even more complexity. In this system, three caves are connected by two conduits. The left cave is connected to the center cave at its lower portion, while the right cave is connected to the center cave via a conduit at top. A production well is located in the center cave that contains water initially. FIG. 3F shows the production data of such a system. As shown in FIG. 3F, the initial production is mostly water from the center cave. After some time, the content of hydrocarbons increases because the replenish fluids come from both the left and right caves. The replenish fluids from the right cave would be hydrocarbons, while the replenish fluids from the left cave would be water initially. The content of the hydrocarbons in the production fluids further increases when water in the left cave is exhausted.

The examples illustrated in FIGS. 3A-3F show how simplified models (or cave geometry) can be used to predict the production data, or to provide a quantitative interpretation of the production data measured from an oil and/or gas well, or set of wells. One skilled in the art would appreciate that the simulator can also be used in inverse fashion to predict the cave geometries based on the production data.

Furthermore, one skilled in the art would realize that the above simplified examples may be used as building blocks to construct more elaborate models that mimic actual cave systems in the subterranean formations.

Figure 4:
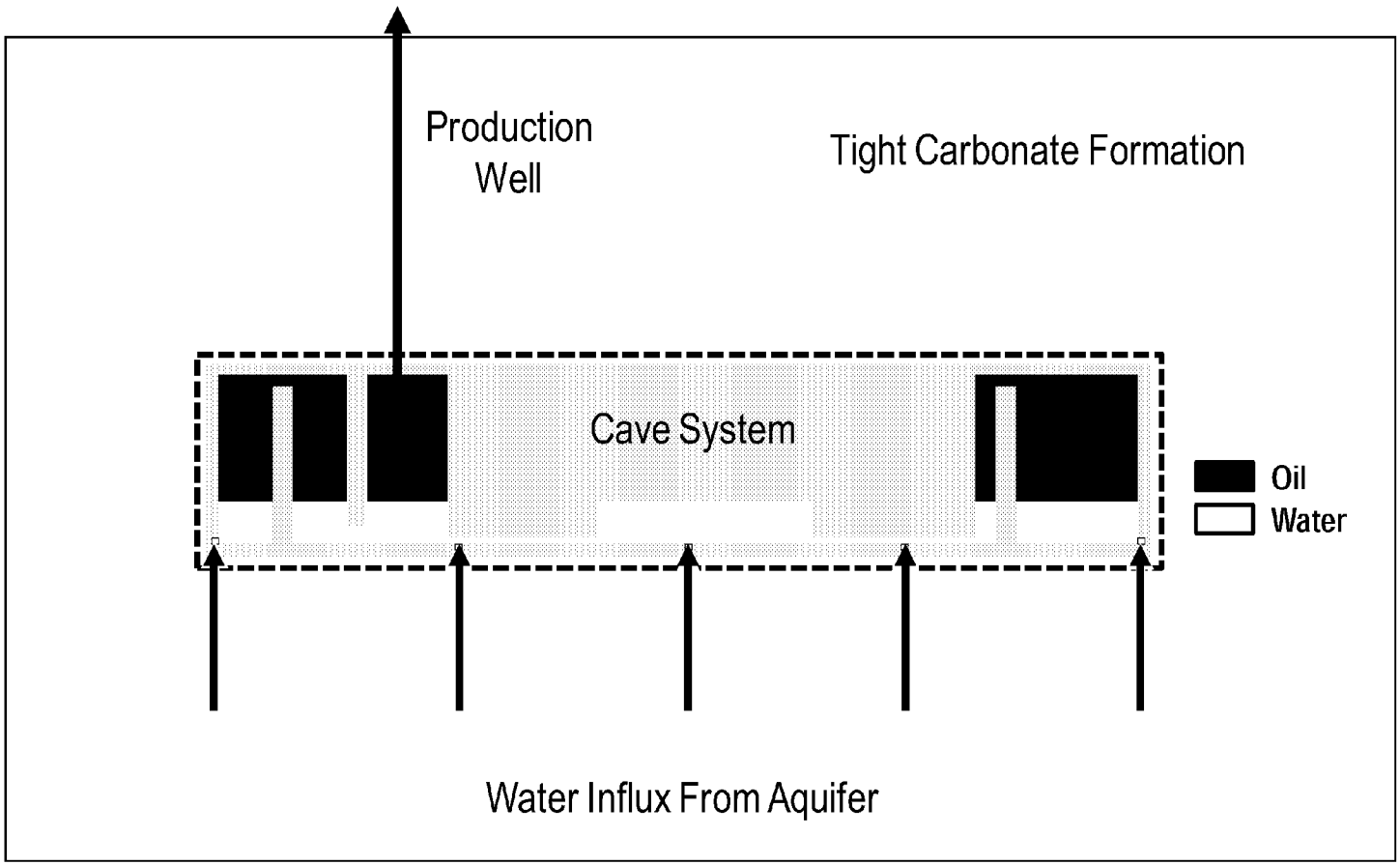
FIG. 4 shows a more elaborate cave system having multiple caves, conduits, and fluid trap in accordance with one embodiment of the invention.

For example, FIG. 4 shows an example that includes several caves in a karst system surrounded by a tight carbonate formation. The cave system may contain oil, water or brine, and possibly free gas (not represented here) occupies a well defined volume (dotted line) within the surrounding carbonate formation. The carbonate surrounding is considered tight, i.e. with very low porosity and very low permeability, such that it can be assumed that fluid exchanges between the carbonate matrix and the cave system are negligible. In this model, the only allowed fluid communications between the cave system and the surrounding carbonate formation are water influx from an aquifer at locations indicated by the arrows. Thus, as the fluids in the cave system are produced from the production well, water is allowed to come into the cave system to replenish the fluids therein.

The flows of oil, water, and free gas in a cave system are controlled by the geometry of the cave system and by the pressure inside the cave system and in the production well. Therefore, a simulator of the invention would take these factors into account.

Cave Geometry Modeling

Karst volumes may have fractal-like shapes that are extremely complex, and caves that may have been free of rocks debris initially may be filled with blocks of rocks, with inter-space filled with rubble and pebbles, and cave floor may be covered by sediments, such as clay or carbonate mud. One skilled in the art would know that various techniques, such as seismic, may be used to determine subsurface cave geometries and shapes. Use of seismic data to validate cave model will be discuss in a later section with reference to FIG. 28.

Figure 5A:
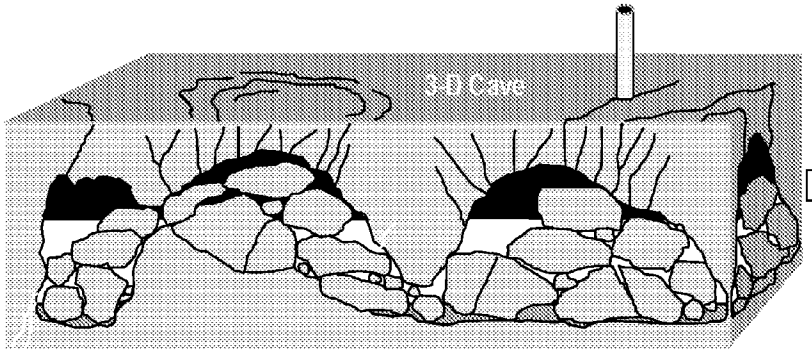
FIG. 5A shows a 3D model of a subsurface cave system.
Figure 5B:
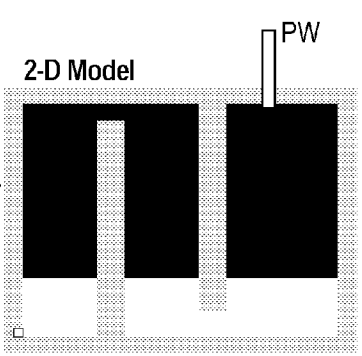
FIG. 5B shows a 2D model representing the 3D cave system of FIG. 5A in accordance with one embodiment of the invention.

FIGS. 5A and 5B illustrates a simplification process that can be used to model the cave geometry. As shown in FIG. 5A, the caves may have various structures and may contain pebbles, rocks, and sediments. However, the detailed structures of the caves are not important for simulation of flow behaviors, as long as the flow rates in these systems are slow enough. What is important is to properly account for large hydraulic structures in the cave system and to account for the exact volumes of the different fluid phases in the system (oil, water, and free gas). Based on this, one can simplify the cave system in FIG. 5A as a simple 2D model shown in FIG. 5B.

In accordance with embodiments of the invention, the models for simulation can be 2-D or 3-D. Almost all systems can be modeled with reasonable accuracy as 2-D systems. However, because most commercial reservoir simulators are designed for 3-D simulations, 3-D representations of karst systems may be more easily adapted to use such commercial systems. For clarity of illustration, the examples in this description are 2-D models, as shown in FIG. 5B. However, one skilled in the art would appreciate that one can also use 3D models without departing from the scope of the invention.

Figure 6A:
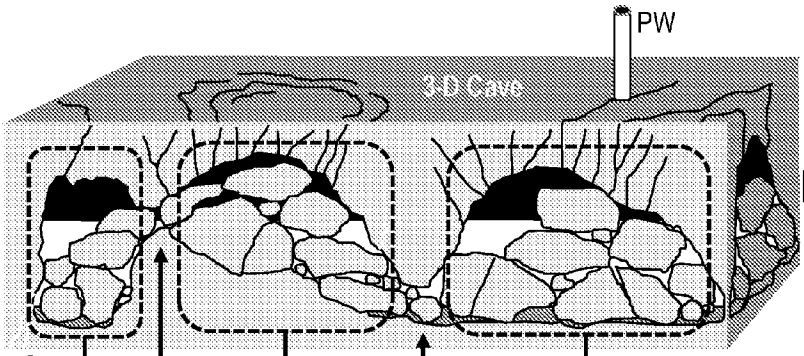
FIGS. 6A and 6B shows how a 3D cave system can be simplified as a 2D model in accordance with one embodiment of the invention.
Figure 6B:
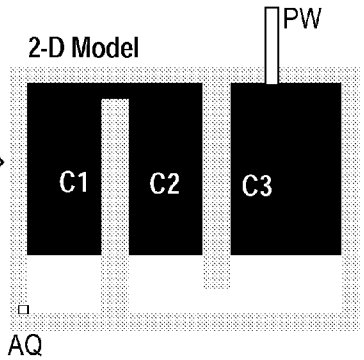

To represent the 3D cave system of FIG. 5A with the 2D model of FIG. 5B, the important points are to accurately represent the volumes of the caves and the locations of the conduits that connects the caves. FIGS. 6A and 6B illustrate this process.

As shown in FIG. 6A, the cave system has three main chambers C1, C2, and C3. Chambers C1 and C2 communicate through an opening located close to the top of the rock wall between the two chambers. This creates an "inverted U-tube" (IU) connection, in which (in absence of free gas) oil in chamber C1 would be the first fluid to enter chamber C2, if the fluid flow is from C1 towards C2, because oil is lighter than water and buoyancy forces the two phases to segregate.

On the other hand, chambers C2 and C3 in this example communicate through a conduit located close to the bottom of the rock wall between the two chambers. Thus, the connection between C2 and C3 is a U-tube connection. Due to buoyancy and fluid segregation, the "U-tube" conduit would allow water to flow first between chambers C2 and C3. In this example, the production well PW is connected directly to chamber C3 or indirectly through a fracture in the rock, for example.

The volumes of oil and water in chamber C1, C2, and C3 in FIG. 6A may be accounted for in the 2D model shown in FIG. 6B. The fractures AQ at the bottom left of chamber C1 form a path for water in the aquifer (not represented here) to flow into the cave system, as the fluids are produced from the production well PW. This water entrance may be represented as a simple arrow in the model shown in FIG. 6B.

In accordance with embodiments of the invention, a karst simulation model would take into account key elements, such as cave chambers C1, C2, C3, conduits U-tubes and inverted U-tubes, and aquifer entry points. These basic elements form key building blocks of the cave system model. Other hydraulic elements, or building blocks, may be designed and used in the models, if needed. Such other elements may include, for example, the "water trap" and "oil trap" elements, shown in FIG. 7A and FIG. 8A, respectively.

As noted above, the flows of fluids in the karst systems are mostly governed by gravity or buoyancy. The oil trap or water trap in the systems are typically caves where one type of fluid (water or oil) is temporarily removed from the main flow stream (or temporarily stored or trapped in the caves) due to the effect of cave geometry and gravity.

Figure 7A:
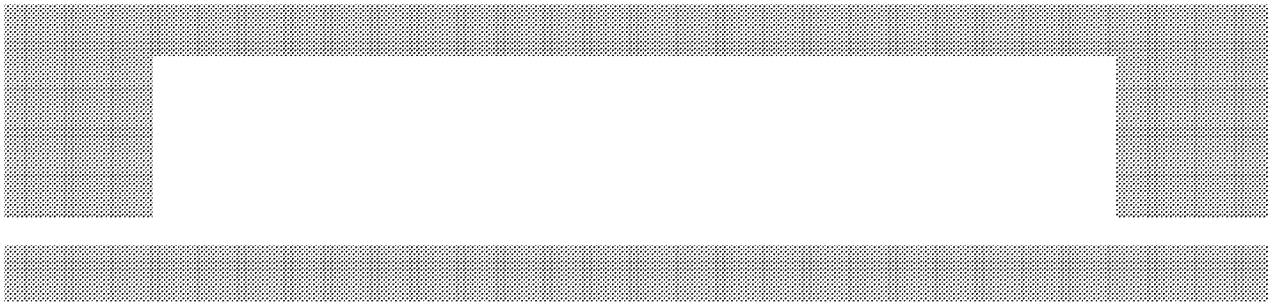
FIG. 7A shows an oil trap element and FIG. 7B shows how the trap can trap oil in accordance with one embodiment of the invention.
Figure 7B:
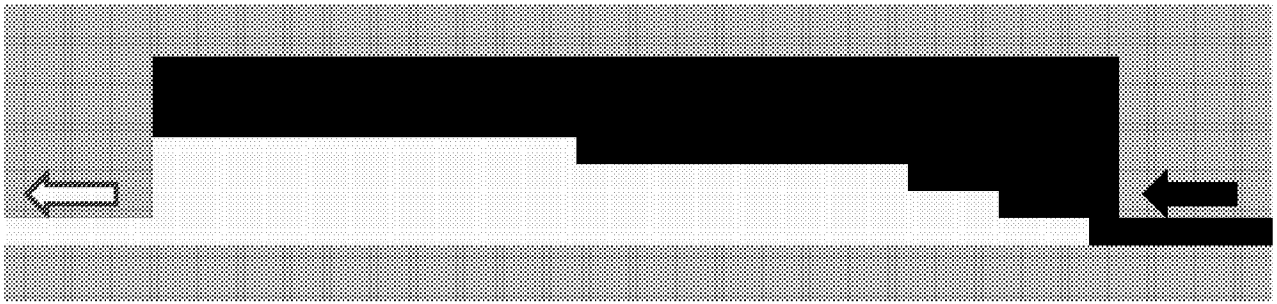

FIG. 7A illustrates an example of an oil trap. The oil trap element may be a cave that is initially full of water. FIG. 7B shows that when fluids flow into the oil trap (from right to left in this illustration), oil arriving from the right flows up in the cave due to buoyancy. For each unit volume of oil flowing into the cave, one unit volume of water flows out of the oil trap (cave) from the left lower conduit. As a result, the oil trap converts a flow of oil into a flow of water until the trap is full of oil.

Figure 8A:
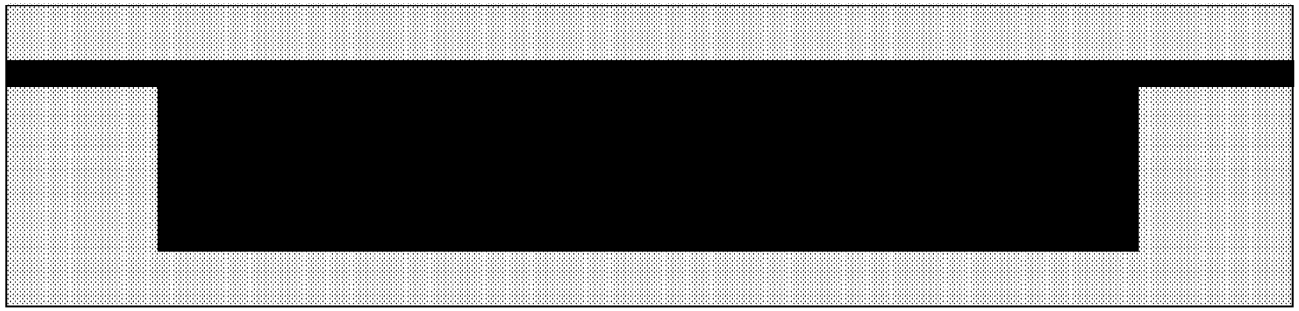
FIG. 8A shows a water trap element and FIG. 8B shows how the trap can trap water in accordance with one embodiment of the invention.
Figure 8B:
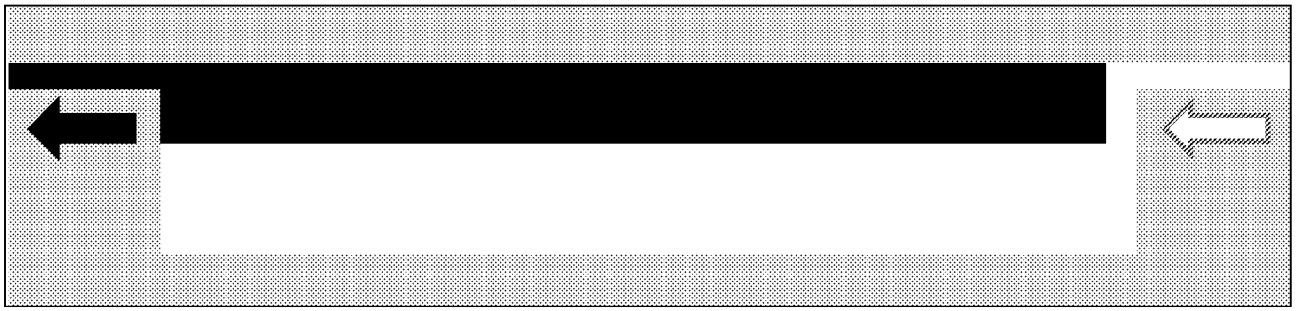

FIG. 8A illustrates an example of a water trap. The water trap element may be a cave that is initially full of oil. FIG. 8B shows that when fluids flow into the water trap (from right to left in this illustration), water arriving from the right would settle down to the bottom of the cave due to buoyancy. For each unit volume of water flowing into the cave, one unit volume of oil flows out of the oil trap (cave) from the left upper conduit. As a result, the water trap converts a flow of water into a flow of oil until the trap is full of water.

As illustrated above, all caves and traps in the models are linked by conduits, which are the simplest elements in the models. The conduits may correspond to natural fractures, vuggy layers, or karst conduits that may be the remains of ancient water flow paths.

In accordance with embodiments of the invention, other elements of a model may include one or more "flow splitter" elements, as shown in FIG. 9 and FIGS. 10A-10C. A flow splitter may be represented in 2D or 3D.

Figure 9:
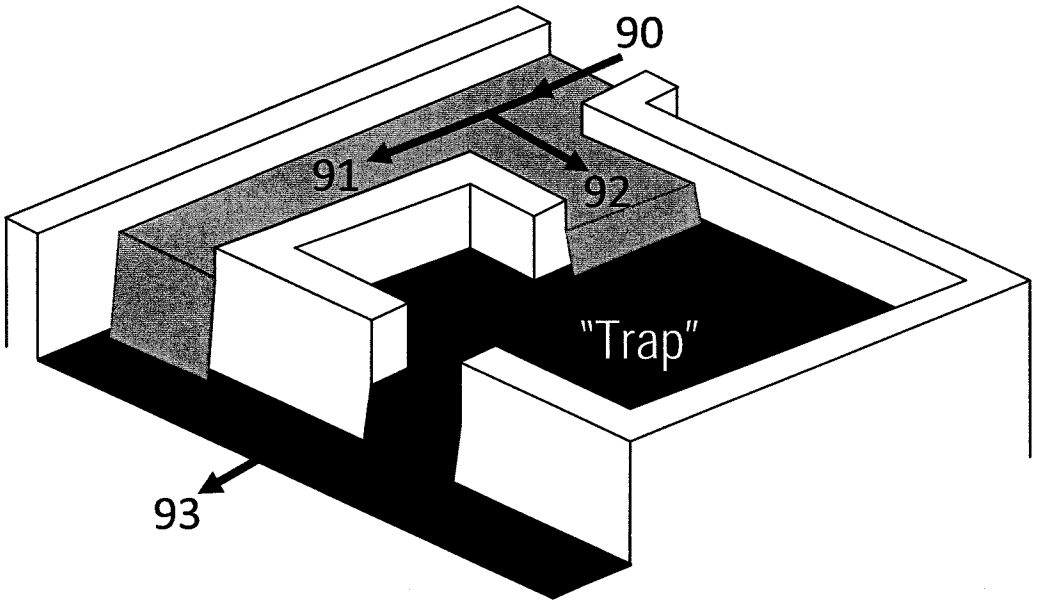
FIG. 9 shows a model with a flow splitter and a fluid trap in accordance with one embodiment of the invention.

FIG. 9 shows an example of a 3-D representation of a water flow splitter. In this example, the water flow 90 entering a cave near its ceiling is split in two flow paths 91 and 92. After passing through the flow splitter, the flow comes out of the system as flow 93. One can also design an oil flow splitter with oil entering a cave (e.g., near its floor).

In the example of FIG. 9, one branch of the splitter brings the water flow 92 into a water trap that converts the water flow into an oil flow. The oil flow out of the trap joins the water flow from the other branch (flow 91) of the splitter to form the effluent flow 93. This configuration converts a water flow into a mixed flow of water and oil with adjustable water and oil flow rate fractions. One skilled in the art would appreciate that in some scenarios, an oil flow may be converted into a mixed water and oil flow (for example, if the trap is an oil trap) and in other scenarios, there might not be any conversion (i.e., water-in and water-out, or oil-in and oil-out).

Figure 10C:
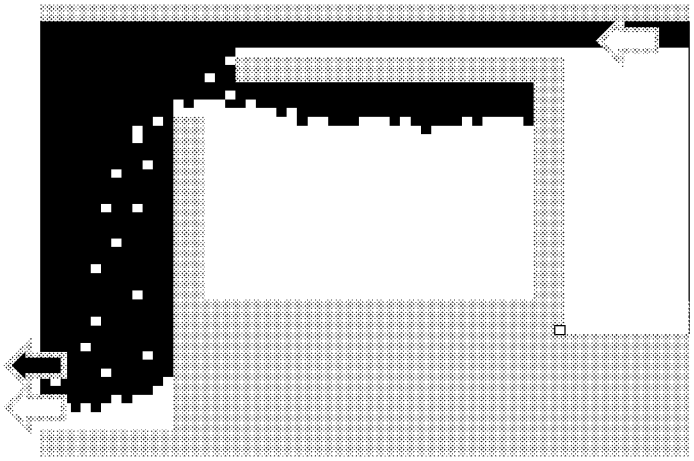
FIGS. 10A-10C illustrates how a flow splitter and a fluid trap impact the fluid flow in accordance with one embodiment of the invention.
Figure 10A:
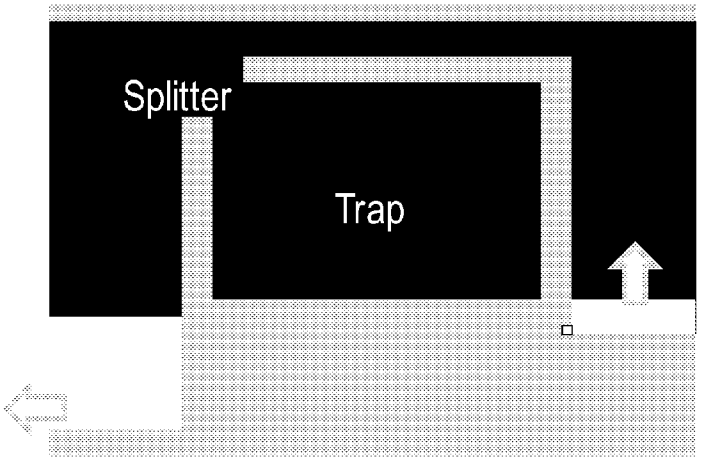
Figure 10B:
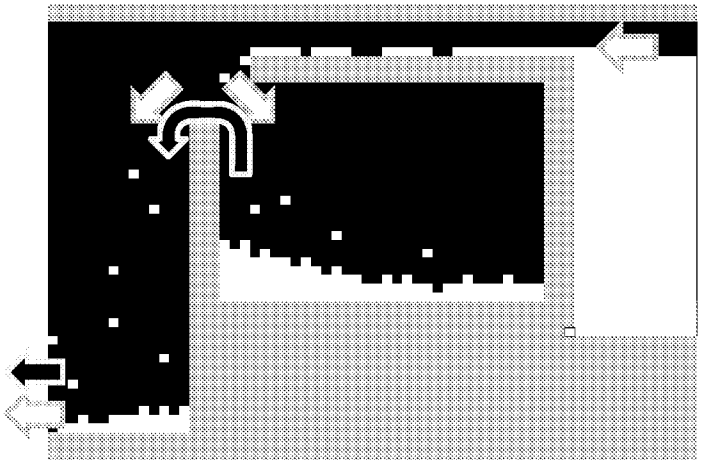

3-D flow splitters are common in real cave systems. However, it is not always easy to design and represent such 3-D flow splitters using 2-D models. FIGS. 10A-10C show how to represent the flow splitter of FIG. 9 in a 2-D model.

FIGS. 10A-10C also illustrate the flows during different times. FIG. 10A shows the system at the start of flow. FIG. 10B shows that when water from an aquifer flows by the splitter, some of the water will flow into the water trap and displaces some oil out of the trap. The displaced oil and the other portion of the water flow then merge and flow out of the system as a mixed water and oil flow. This mixed water and oil flow out of the system has a stable water/oil ratio until the trap is full of water.

FIG. 10C shows that when the water trap is full of water, the water flow that is split into the trap would displace water from the trap. As a result, the system would no longer convert incoming water into a mixed flow of oil and water, i.e., the flow would become 100% water. This example also illustrates that when a splitter is connected to a trap that contains the same fluid as the incoming fluid, the trap has no impact on the compositions and total flow rate of fluid flows. In other words, the existence of the splitter and the trap would become "invisible" in the production curve analysis when the trapped fluids and the incoming fluids are the same.

The above describes examples of various elements and parts, as well as their functions, that may be used in simulation models to represent a karst system. The following will show some examples of how these parts that may be used to simulate karst systems.

Graphical Representations of Cave Models

Figure 11:
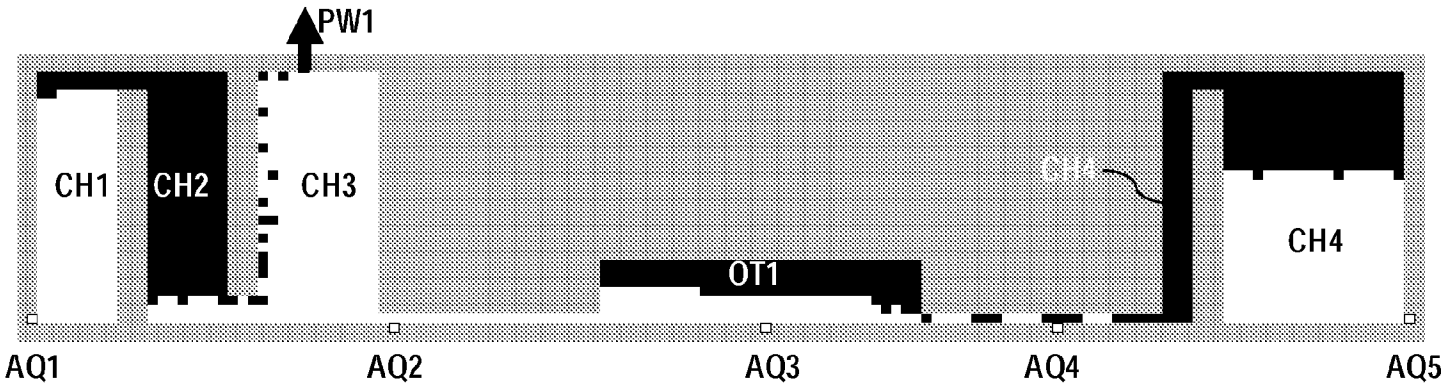
FIG. 11 shows a reservoir model representing a karst system in accordance with one embodiment of the invention.

In accordance with embodiments of the invention, the karst system models may be presented in various graphical representations that can serve the same purpose. For example, FIG. 11 shows a 2-D model of a karst system using the "graphic elements" described above. In this model, the karst system include five caves/chambers (CH1, CH2, CH3, CH4, and CH5) and an oil trap (OT1). A production well connects with cave CH3.

Figure 12:
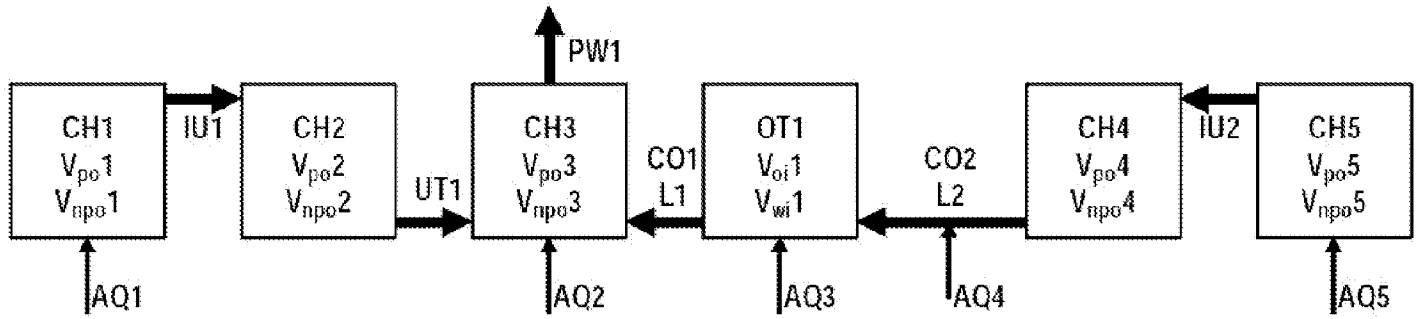
FIG. 12 shows a symbolic representation of the reservoir model of FIG. 11 in accordance with one embodiment of the invention.

In an alternative representation, the same karst system shown in FIG. 11 may be represented by a symbolic representation model shown in FIG. 12, where all the hydraulic building blocks and their respective properties are listed in a schematic hydraulic diagram. The hydraulic elements listed in the symbolic representation in FIG. 12 may include some of their hydraulic parameters. For example, the cave chamber 1 (CH1) has a volume of producible oil $V_{po}$1 and a volume of non-producible oil $V_{npo}$1. The volume $V_{po}$1 will flow through the inverted U-tube element IU1 into chamber CH2 and water will come from the aquifer entry point AQ1 into CH1 to replenish the volume of oil that is being produced. This will continue until all the oil is produced.

In this example, the oil trap OT1 contains an initial oil volume $V_{oi}$1 and an initial water volume $V_{wi}$1. It is connected to cave chamber CH3 through a conduit CO1 of length L1. The production well PW1 produces fluids from cave chamber CH3.

Figure 13:
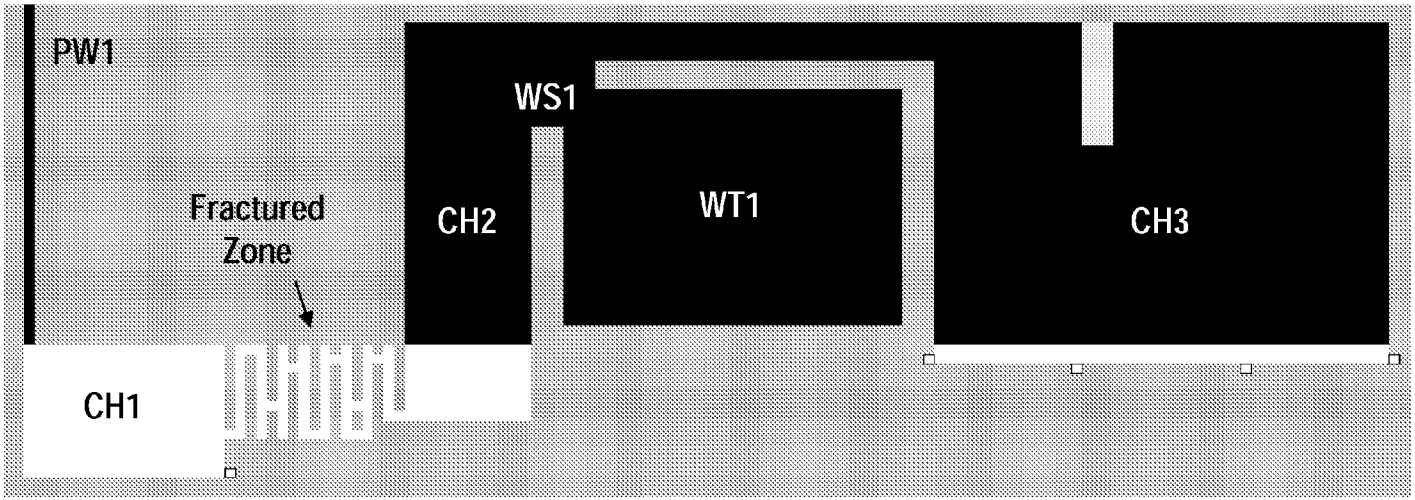
FIG. 13 shows a reservoir model containing a fracture zone in accordance with one embodiment of the invention.
Figure 14:
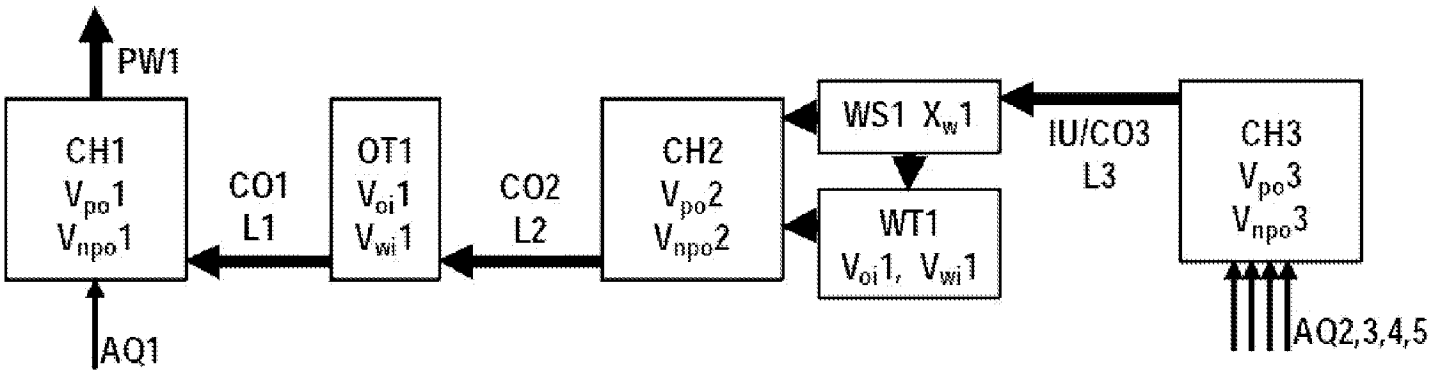
FIG. 14 shows a symbolic representation of the reservoir model of FIG. 13 in accordance with one embodiment of the invention.

Another example of a cave system model representation is shown in FIG. 13 and FIG. 14. In this second example, a naturally fractured zone that connects two cave chambers (CH1 and CH2) is represented in FIG. 13 as a long conduit going up and down with inverted U-tubes and U-tubes. This element is actually acting hydraulically like simple conduits (CO1 and CO2) and a very small oil trap (OT1), as shown in the symbolic representation in FIG. 14.

In the middle of FIG. 13, a water splitter (WS1) and water trap element (WT1) is shown. This water splitter (WS1) and the water trap element (WT1) are like the ones presented in FIG. 10. The symbolic representation in FIG. 14 shows a water splitter (WS1) that produces a water volume fraction $X_w$1 for 100% water inflow, as long as the water trap (WT1) is not full of water. The initial volume of water in WT1 is $V_{wi}$1, which may be zero in most cases of water traps. The total amount of water this trap can take is therefore equal to the initial volume of oil $V_{oi}$1 (assuming all the oil in this trap is producible). In the example shown in FIG. 14, there are four aquifer entry points in cave chamber CH3. This will be explained below.

The above description shows that a model of the invention may be represented in graphical models or symbolic representations. In addition, the various parameters may be included in the models. Based on these models, the fluid movements in the system may be simulated with various approaches.

Flow Dynamics and Cellular Automata Technology

As noted earlier, when one volume of fluids is removed (produced) form the karst system, an equal volume of water form an aquifer outside the karst system being modeled is allowed to come in to replenish the removed volume. Based on this principle, simple approaches may be implemented to simulate fluid movements in the model. For example, the following will describe an example implementing a very simple Cellular Automata (CA) 2-D simulator for multiphase flow dynamic simulation of cave systems. This implementation has been successfully implemented and tested with a prototype software using Visual BASIC on Excel. This example is limited to two-phase flows. However, this can be easily extended to three-phase flows. Similarly, the description is for a 2-D simulator. However, one skilled in the art can easily extend this to a full 3-D system.

Space Gridding and Fluid Cells

Figure 15A:
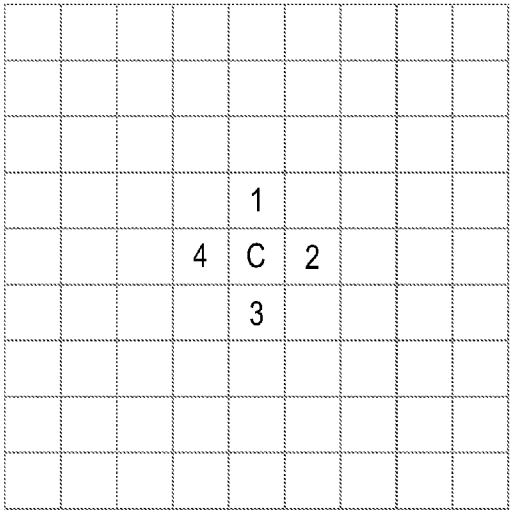
FIG. 15A and FIG. 15B illustrate a cell movement according to the cell automata technology in accordance with one embodiment of the invention.

As an example, the space (a 2-D Euclidian plane in this example) where the fluid movement is modeled may be divided into small cells, i.e., "tiled" using a square grid, as shown in FIG. 15A. Other tiling methods may also be used, such as using triangles, rectangles, hexagons, or other polygons. However, all cell grids should have the same volume in this CA simulator. In the square grid tiling shown here, each cell C can "move" or exchange content with its four neighbor cells 1, 2, 3, and 4, as shown in FIG. 15. Note that the other four corner (diagonal) cells around cell C could also be allowed to move. However, for simplicity and clarity of illustration, exchanges are restricted to non-diagonal cells here. Based on the description here, one skilled in the art would know how to modify the rules to include these diagonal cells.

Figure 15B:
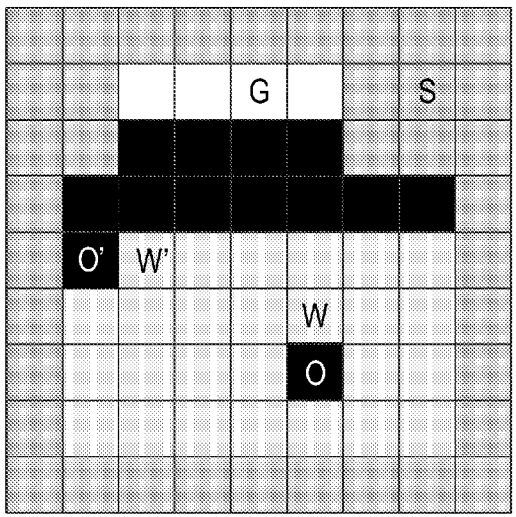

Cells may be color coded according to their contents or functions. For example, solid cells (S) representing non-permeable rock may be in grey color; oil cells (O) may be in black; water cells (W) may be in blue; and free gas cells (G) may be in white. Alternatively, these may be shown with different patterns or in different gray scales, as illustrated in FIG. 15B.

Some examples of functional elements have been described above. These include the production well (PW) shown in FIG. 5B, and the aquifer entry point (AQ) shown in FIG. 6B. Another example is the gas injector well (GI) shown in FIG. 2C. These and other functional elements may be shown in cells with different color or pattern codings.

These square cells may be symbolic representations of reality. For example, the actual vertical size $\Delta z$ and horizontal size $\Delta x$ of the cell may not be equal. However, for simplicity and clarity, these cells are shown as squares in the example.

CA Rules for Cell Moves

Having defined the space as 2D cells, one would next define the rules of how fluids (cells) move in the models. By definition, solid cells and functional cells do not move because they are not fluid cells.

In CA simulators, one can consider the fluid movements in discrete time steps. At each time step $\Delta t$, the fluid cells can "move" to or exchange content (or not) with one of their neighbor cells. One time step corresponds to a discrete jump in the vertical direction (up or down), or in the horizontal direction (right or left). That implies that the maximum velocity in the vertical direction for a cell is equal to $\Delta z/\Delta t$ and the maximum velocity in the horizontal direction is $\Delta x/\Delta t$.

The relative values chosen in the model for the cell size ($\Delta x$, $\Delta z$) and the time step $\Delta t$ preferably are compatible with actual fluid velocities observed in the real word. By defining CA rules for cell moves according to real world expectations, the simulation outcomes may be more relevant. For example, what is the vertical velocity of a gas bubble moving in water under the sole influence of buoyancy, as compared to the velocity of an oil droplet of same diameter?

It can be shown that the limit velocity of a bubble moving up in water is directly proportional to the difference between water density $d_w$ and the bubble fluid density $d_f$. Therefore, the ratio of the velocities for a gas bubble and an oil droplet of same size is simply: $R=(d_w-d_g)/(d_w-d_o)$. Under atmospheric conditions, this is roughly equal to 5. Under pressure conditions of a deep oil reservoir, e.g. several hundred bars, the density of a free gas (such as methane or nitrogen) is several hundred times its density at 1 bar. For example, at 400 bars the ratio R can only be 3 instead of 5.

The CA simulator can easily account for this by giving a treatment of favor to gas cells over oil cells. One example of algorithm that achieves the objective is as follows: At each time step, all oil and gas cells are considered for a move. If the cell is a gas cell, it is always considered for a move. If the cell is an oil cell, a random number X is drawn with a uniform distribution between 0 and 1, and if X is between 0 and 1/R the cell is considered for a move. Otherwise, it is not. In other words, the probability for any oil cell to be considered for a move at each time step is R times lower than for a gas cell. Therefore, its maximum velocity is automatically R times slower than that for a gas cell.

The above is only one example. One skilled in the art would appreciate that other rules may be adopted to take care of the different probabilities of a move based on the relative move propensity factor R. This kind of rule is called a conditional rule. It is in fact a conditional or probabilistic rule. The conditions applied may be made much more complicated to account for more complex situations.

CA rules for cell moves may be defined for all situations. The following describes an example of a set of rules for a two-phase 2-D CA simulator, e.g. for oil and water. However, one skilled in the art would know that this can be easily modified to include more than two phases.

In a closed system, i.e. a cave system that has no fluid exchanges (i.e., no production and no water entry), the oil and water phases segregate quickly from their initial position to a stable equilibrium with oil at the top level and water below, with a horizontal oil/water contact (OWC) separating the two fluids.

In such a closed system, only the oil cells need to be considered for moves at each time step. In reality, the water cells are moving too, to occupy the spaces left behind after oil cell moves. However, there is no need to explicitly deal with the moves for water cells.

As an example, one set of rules for oil cell movements in a closed system may be as follows:

Rule 1: If the cell just above an oil cell O is a water cell W (see FIG. 15B), the two cells are swapped.

Rule 2: If all three neighbor cells above, right, and left, of an oil cell are not water cells, the oil cell does not move.

Figure 16:
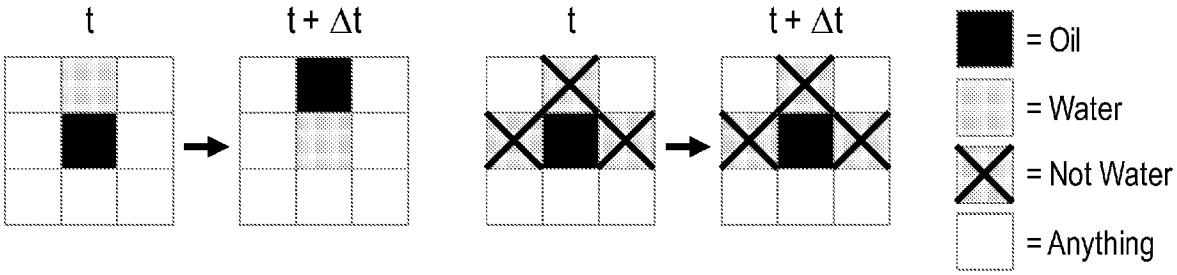
FIG. 16 shows graphical representation of cell movement in accordance with one embodiment of the invention.

These two rules can be symbolized as shown in FIG. 16. Here, cells containing different fluids are labeled. Blank cells can contain anything.

Rule 1 is obvious, and Rule 2 is easy to understand: Cells other than water cells are oil cells, solid cells, or functional cells. Obviously, oil cannot go into a solid cell, and if oil swaps with an oil cell the result is the same as if the oil cells do not swap. Finally, in a closed system oil cannot go into any functional cell.

Figure 17:
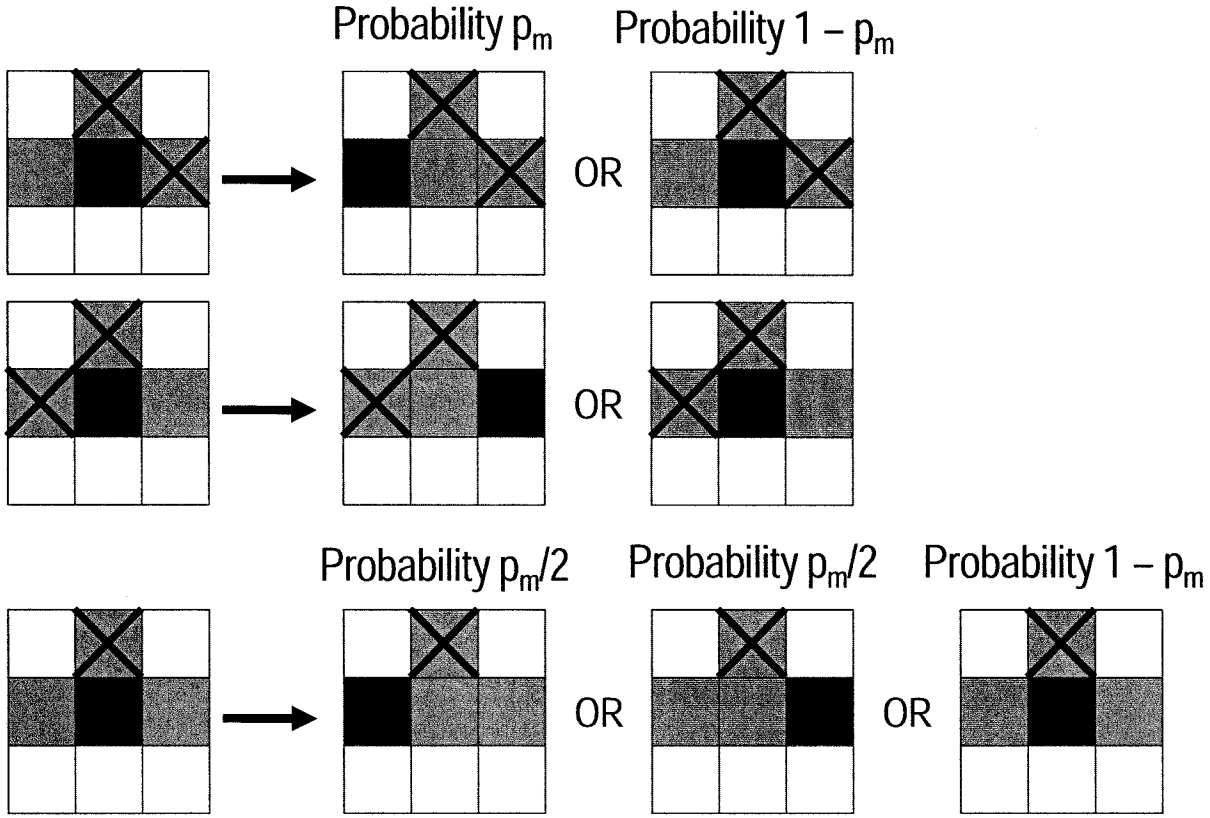
FIG. 17 shows graphic representation of cell movements involving fluids of different moving velocities (e.g., fluids and gas) in accordance with one embodiment of the invention.

While the above model assumes an oil cell either moves or does not move, i.e., a 0 or 1 event, one can also expand the model to include probabilistic moves. For example, one can introduce a probability of move $p_m$ (having a value from 0 to 1) as a parameter of the model for situations where a cell can move in different directions, or stay put. The outcome of the rules is probabilistic. FIG. 17 illustrates a set of rules that take into account probability of move. In this example, there are three rules. The three rules shown in FIG. 17 can cover all cases for a closed system.

For example, referring to FIG. 15B, if we assign a probability of move $p_m=1/10$ (i.e., 10% probability) for the oil cell O' in FIG. 15B to swap with the water cell W' at the next time step. This oil cell will do a random walk just below the oil water interface (always staying at the same horizontal level) because it cannot move any higher. On the other hand, based on Rule 1, oil cell O in FIG. 15B will move upward in two consecutive time steps. At the end of time step 2, cell O will reach just below the oil water contact and will start doing the same random walk as cell O'.

In the real world, oil cells have the sizes of oil molecules and the oil water contact appears perfectly still to the naked eye. However, in reality the oil molecules actually perform rapid and complex random walks, similar to what the CA simulation shows with "big" cells.

Additional Rules for Open Systems

The above description assumes a closed system, in which no cells (fluid) move into or out of the model. However, in a system with a production well, cells (fluid) reaching the producing well (PW) are produced one at a time (one per time step) and exit the cave system. When fluid exits the cave volume, it should be replaced by the same amount of fluid to avoid leaving an empty space behind. Therefore, for each fluid cell exiting through PW, one fluid cell would come in from a source outside the karst system (e.g., one of the aquifer entry points).

In accordance with embodiments of the invention, a simulator may pick randomly a producing aquifer entry point at each time step. On average, each aquifer entry point may contribute equally over time. If a model requires one of the caves to produce more fluids than other caves in the system (for example to match some real production data), several aquifer entry points can be placed in that particular cave (i.e., the higher production cave). In other words, the number of aquifer entry points may be adjusted in order to reproduce the flow behavior observed in a real well. Another way to allow aquifer entry points to contribute differently is to assign a water production flow capacity (e.g., relative production capacity or probability) to each aquifer entry point.

A cell exiting the cave system at PW at time step t would be replaced by the content of a neighbor fluid cell, which itself is replaced by one of its neighbor fluid cells, etc. This process propagates a chain of moves between the exit point (PW) and one of the aquifer entry points (AQx), where finally a water cell enters the cave system to fill the gap created by the cell exiting at PW.

In a simple model, the fluids (oil and water) are assumed not compressible. That implies that the propagation of the gap described above all happens within one time step no matter how far the exit point PW is from the selected aquifer entry point AQx. However, the CA rules as described above are local rules: a fluid cell moves according to a set of rules that only account for neighbor cells. Thus, quickly propagating a gap from PW to AQx requires the cells to follow a path that goes through the system avoiding solid cells (e.g., the wall of the caves). This path can be convoluted and may be a function of the geometry of the entire cave system. Thus, the knowledge in a single time step of this entire path is not local. Even though this path may be convoluted, one can still simulate this path based on the simple rules described above, assigning probabilities to different alternative cells for each move step. However, an easier alternative is described next.

To overcome this difficulty (non-local) and to keep the simulator simple and fast to run on a simple computer system, such as a regular laptop PC (e.g., using a Visual BASIC software on Excel, etc.), a special algorithm may be implemented that looks once and for all—before the simulation starts—for all the "short paths" between the functional cell PW and all aquifer entry points AQx in the cave system. There are many ways to look for short paths between two cells in a maze.

For example, an algorithm may list all shortest paths between PW and AQ1, i.e. paths with a minimum length $L_{min}$1, as well as all paths with lengths at most $L_{min}$1+k, wherein the integer k is a parameter of the simulator. The number of all these "short paths" between PW and AQ1 is referred to as N1. The same is done for "short paths" between PW and all other aquifer entry points, AQ2, . . . , AQn, in the cave system. The numbers of "short paths" leading to all other aquifer entry points are N2, . . . , Nn, respectively.

This algorithm gives the simulator the non-local knowledge required to propagate the gap in one time step. A probabilistic routine may be used to do so. For example, at each time step, a fluid cell exits the system through PW, and the software draws a random integer m between 1 and n (with uniform probability distribution) to decide which Aquifer entry point AQm to use. The software then picks a random integer between 1 and Nm (for the selected aquifer) where Nm is the number of "short paths" between PW and the selected aquifer, AQm. The selected short path is a chain of grid cells that all contain fluids and is used to propagate in one time step the gap between PW and AQm. The software then runs the normal moving rules as defined for a closed system by checking all non-water fluid cells one by one. This completes the cycle for one time step, and time is incremented to the next time step and a new cycle begins.

Figure 18:
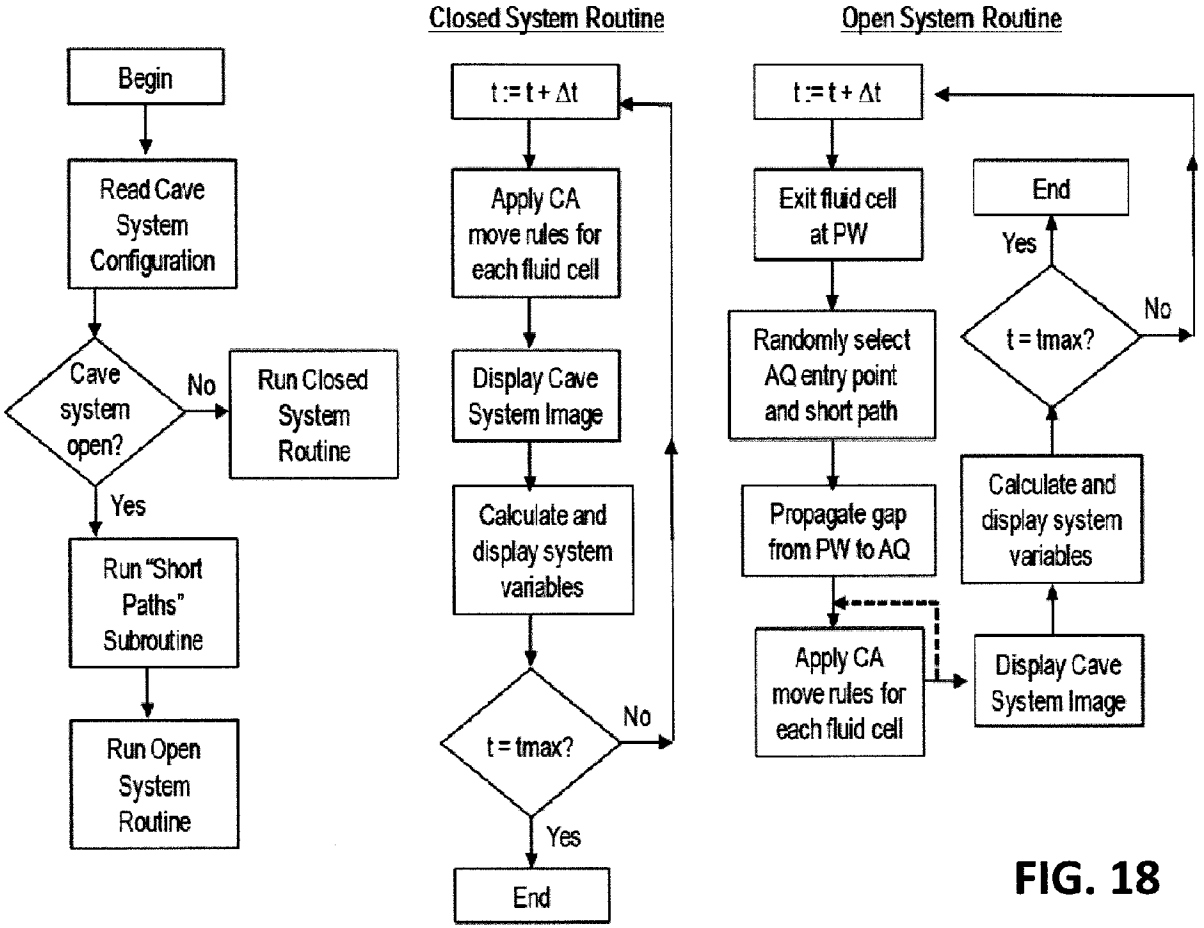
FIG. 18 shows flowcharts illustrating fluid movement based cell movement rules in accordance with one embodiment of the invention.

The approach described above may be summarized in the diagram shown in FIG. 18. As shown, the program may start with inputting the cave system configuration and then decide whether it is a closed system or an open system. If it is a closed, the closed system routine would be used.

If it is an open system, the program would run a "short path" subroutine first to identify the "short paths" for moving the fluid from one or more aquifers to the production well. Then, the open system routine is used.

There are many possible variations in the implementation of such software, including, for example, different ending criteria (other than a maximum time). In addition, the CA rule represents one of many approaches that can be used to model the fluid movements. While the CA rule approach is simple and easy to implement, any other suitable approaches may be used without departing form the scope of the invention.

A karst system simulator according to embodiments of the invention may be used in various situations, including forward simulation (e.g., prediction of production curves based on cave systems, which may have been determined using other techniques, such as seismic techniques) and reverse simulation (e.g., modeling to fit actual production data in order to arrive at possible cave structures). The following will describe some examples to illustrate embodiments of the invention.

Simulating Fluid Production Decline

A simulator described above is capable of predicting or reproducing a "water cut" curve (i.e., the water volume fraction in the fluid produced versus time) observed in a well producing oil, gas, and water from a karst system. However, in a simple implementation of the simulator, it would not include pressure information in the cave system, in the aquifer, and along the producing well. Therefore, it cannot calculate the actual volume flow rate output of the cave system.

If desired, this simple system can be improved by applying a pressure calculation routine based on the cave system parameters (fluid properties, cave volume, initial reservoir pressure, etc.) and based on the exchange parameters between the cave system and the aquifer and eventually the surrounding rock matrix. Such algorithm and software are commonly available in the oil and gas industry (e.g. ECLIPSE). Each time a fluid volume is produced through PW, the effect is a small reduction of the reservoir pressure. The magnitude of this reduction depends on the system parameters: it can be very small—hardly noticeable in fact—for large systems with compressible fluids, e.g. oil containing significant amount of dissolved gas. The simulator may also account for the pressure along the producing well that depends on the type of completion in place, e.g. artificial lift system or not, chokes and nozzles, etc. The results of these simulations may include decline curves versus time for the reservoir pressures and for the produced flow rates.

This curve is also a function of the water cut produced. If the well is producing under the sole effect of the reservoir pressure, the hydrostatic pressure at the base of the well PW is directly proportional to the average fluid density in the well over the entire well column. This density is a linear function of the water cut in the well. The higher the water cut the higher the fluid density and the lower the natural production rate. All these effects can easily be accounted for in the software to produce a decline curve for the total fluid volume flow rate produced versus time Q(t).

The dotted arrow in the "Open System Routine" in FIG. 18 indicates the option of looping several times—say k times—the moving rules subroutine. The physical "clock" in the model is the time it takes for one oil cell to move up and swap with a water cell. This is the time step $\Delta t$. If at time t the expected average fluid volume flow rate produced out of the well PW is Q(t), then $Q(t)=V_{cell}/(k\cdot\Delta t)$, wherein $V_{cell}$ is the volume of a grid cell. Therefore, the number of loops k could be chosen to be $k=V_{cell}Q(t)/\Delta t$ and changed versus time t according to the flow rate output curve.

The combination of the total fluid flow rate curve Q(t) and the water cut curve given by the CA simulator allows one to immediately calculate both the oil and water flow rates versus time. Utility of embodiments of the invention in such applications will be further illustrated in the following case studies.

Application of the Workflow and Simulator to Interpret Water Cut Curves

Case Study 1

Figure 19:
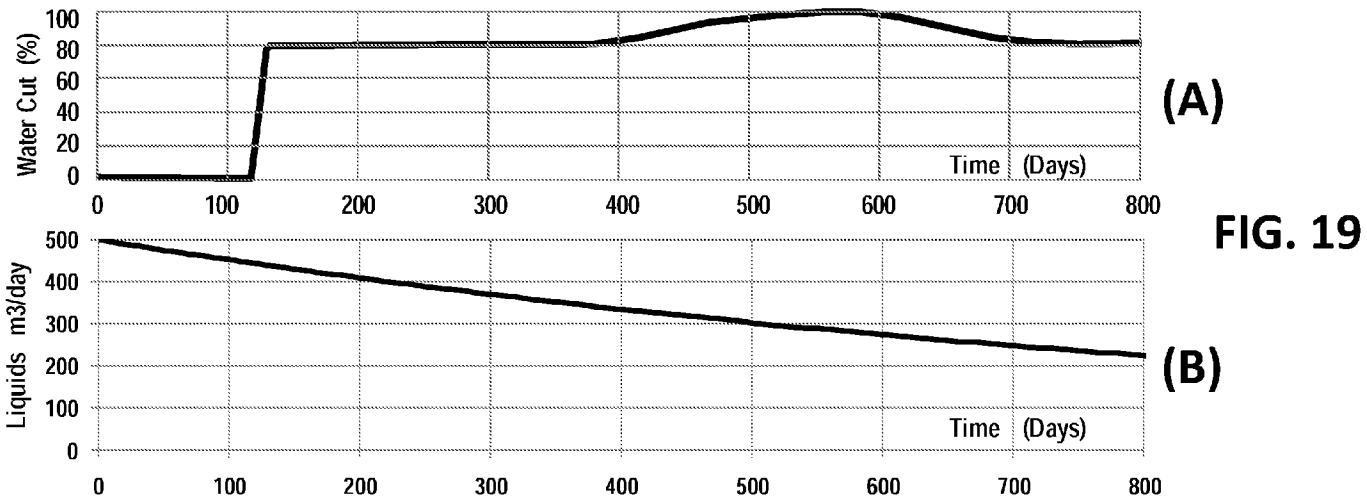
FIG. 19A and FIG. 19B shows charts of water cuts and flow rates, respectively, of a production curve in accordance with one embodiment of the invention.

In this example, a well produced a mix of oil and water with a water cut curve shown in FIG. 19A. During the first four months (120 days), the well produced dry oil (i.e., water cut is zero). The water cut sharply increased to 80% and remained constant for the next 250 days. The water cut then increased gradually to reach 100% around 560 days after production start. Surprisingly, the water cut then dropped gradually to stabilize back to 80%.

The production decline curve shown in FIG. 19B is not an actual curve from the well, but an expected total liquid flow rate after removing the effects of various nozzle changes that were made during the two years of production.

This type of water cut curve shown in FIG. 19A is never seen in conventional oil reservoirs (i.e., non-cave systems). Three things are special in this cave system: (1) the sudden increase of the water cut from 0% to 80%; (2) the 250-day long plateau with constant 80% water cut; and (3) a surge (recurrence) of oil production after water cut had reached 100%. In conventional reservoirs, water cut tends to increase with a monotone trend, and when it reaches 100%, the reservoir will continue producing 100% water—i.e., no more oil production.

Based on this water cut curve, four main phases are considered in building a cave system for this case:

Phase 1: Dry oil production—From day 0 to day 120

Phase 2: Plateau water cut at 80%—From day 130 to day 380

Phase 3: Gradual increase to 100% water cut—From day 380 to day 580

Phase 4: Water cut decrease and plateau at 80%—From day 580 to day 800

Phase 1

Figure 20:
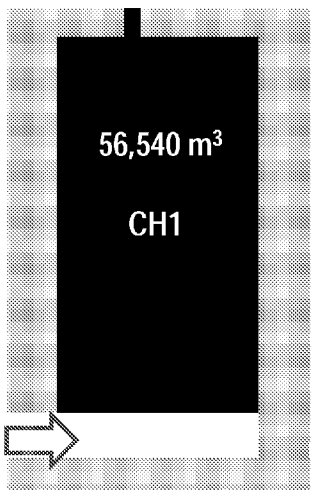
FIG. 20 shows a cave with content and volume of a fluid as derived from the production curve of FIG. 19A.

Obviously, the production well is connected to a cave chamber that contains sufficient dry oil for 120 days of oil production. The total volume of oil produced during this phase (based on the production data) is 56,540 $m^3$. That volume gives an indication of the free volume occupied by oil in this cave chamber. The actual volume of oil initially in the chamber may be larger, but not all of it can be produced. This cannot be assessed from the production data; it depends entirely on the cave chamber geometry which is unknown. FIG. 20 presents a cave model at this stage.

Phase 2

In the model for phase 1, the oil produced at the top of the cave is replaced by water entering the cave at the bottom. Once the oil level reaches the chamber ceiling, the water cut would sharply increase to 100%. However, the water cut value observed is 80%, and it is stable for 250 days. That implies that one oil cell is produced every four water cells. The cave system model needs to be designed accordingly.

One simple way to achieve this is to consider oil arriving in CH1 from one conduit, and water arriving in CH1 from another conduit with a flow rate four times the oil flow rate. A simple way this can be achieved is with a cave system model shown in FIG. 21.

In this model, the five aquifer entry points will produce water at the same average rate. Each time AQ1 is producing a water cell, it will push oil from chamber CH3 into chamber CH2 through the inverted U-tube at the top, and the bottom oil/water contact in chamber CH2 will gradually go down until reaching the U-tube to enter chamber CH1. The volume V' in chamber CH2 therefore is approximately equal to one fifth of the producible oil volume in CH1, i.e. $V'=V_{po}\mathbf{1}/5=56,540/5=11,300$ $m^3$. With this configuration, the water cut goes to 80% when the oil initially in CH1 has been produced.

The 80% water cut plateau lasts 250 days, and in that plateau phase, the total amount of oil produced (based on the production data) is 20,300 $m^3$. That volume corresponds to the volume $V_{po}\mathbf{3}$ of producible oil in chamber CH3 minus the volume V'. Therefore, $V_{po}\mathbf{3}=20,300+V'=31,600$ $m^3$.

The volume of oil in CH2 cannot be determined from the production data. However, this is not important because the volume of CH2 is irrelevant, except for V'.

Phase 3

One interesting question is: why would the water cut increase gradually to 100% after the volume of producible oil in CH3 is produced? One would think the increase should be sudden. This is where a simulator of the invention can provide a significant contribution. The moves of oil and water cells along the complex path CH3→inverted U-tube→CH2→U-tube→CH1 and the random mixing with the water flow coming from AQ2/3/4/5 actually translate in a gradual increase of the water cut from 80% to 100%.

In fact, the water cut is actually erratic in the production well PW. When an oil cell is produced, the water cut is 0%, and when a water cell is produced, the water cut is 100%. Therefore, the instantaneous water cut in the simulator is either 0% or 100%. In order to calculate the water cut provided in the production data the simulator may take an average over a certain number (e.g., 20) of time steps (i.e. 20 cells produced). One consequence of this averaging is that the increase of the water cut from 0% to 80% after 120 days is not as sharp as in the actual well. To avoid that problem, one can reduce the cell size in the simulator, and/or reduce the time step accordingly. However, this comes at the expense of an increased running time for the software.

Large cell sizes allow for completion of a 1000-day simulation in two minutes on a laptop computer with a 2-D model that has less than 2000 fluid cells. In this Case Study 1 example, the cell size is approximately 220 $m^3$. That is quite large. Because the total fluid rate is on the order of 220 to 500 $m^3$/day, the corresponding time step is half-a-day to one day.

Despite the averaging over 40 time steps, the water cut curve obtained with the simulator remains quite erratic due to the random nature of the simulation of cell moves. To overcome that problem, one can do many simulation runs and take the average of all the water cut curves obtained. The actual curves presented at the end of this section are the average of 25 simulation runs.

Phase 4

In phase 4, new oil reaches CH1 around 580 days after production started. This oil comes from another cave located far away from the main cave CH1/CH2/CH3. In a 2-D model, one can choose to design this arrival from the left or from the right; it does not matter. This reflects the symbolic nature of the graphical representation. One way to delay the arrival of oil from this second cave to CH1 is to add an oil trap on the way. The oil trap serves to delay the arrival of oil. One example of the model is a cave system shown in FIG. 22. Other alternatives may be designed that will have similar hydraulic behavior.

Figure 21:
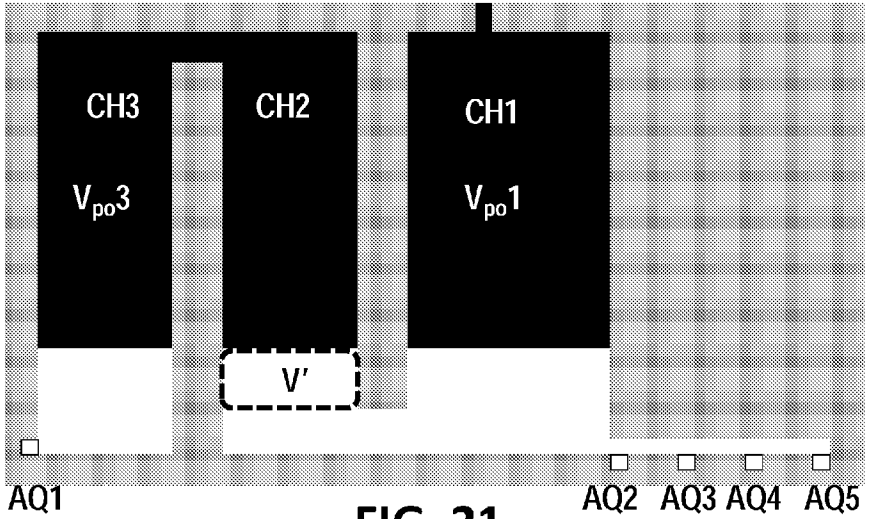
FIG. 21 shows a reservoir model that can account for earlier phases of the production curve shown in FIG. 19A.
Figure 22:
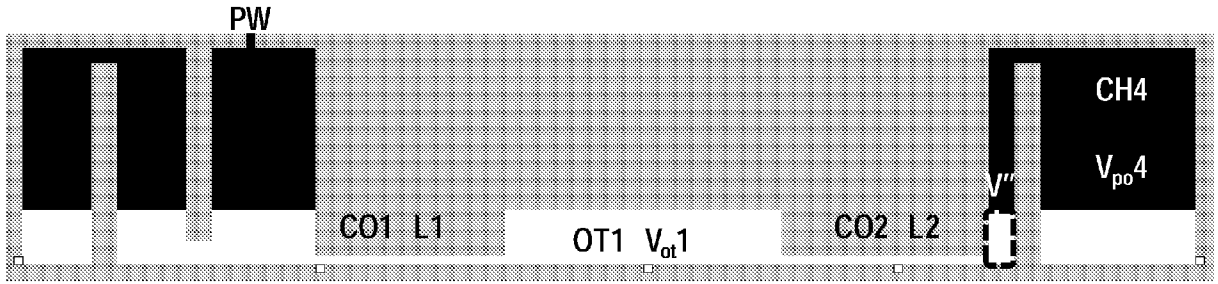
FIG. 22 shows reservoir model that can account for all phases of the production curve shown in FIG. 19A.

In FIG. 21, the four aquifer entry points AQ2/3/4/5 are spread along the cave system structure towards the right. AQ5 is actually required to be located in the new cave CH4 to push the oil towards CH1, as shown in FIG. 22. Because the water cut drops back to 80%, there is only one aquifer entry point in CH4, while the four other aquifer entry points provide water production. For example, if CH4 contains both AQ4 and AQ5, the water cut will stabilize to 60%, provided that there is enough producible oil in CH4. The total volume of oil from the new cave CH4 that will reach CH1 and be produced is equal to $V_{po}$4−V"−$V_{ot}$1. The lengths of the conduits CO1 and CO2 and/or the oil trap volume $V_{ot}$1 should be adjusted in order for the timing of the oil arrival to be correct.

Figure 23:
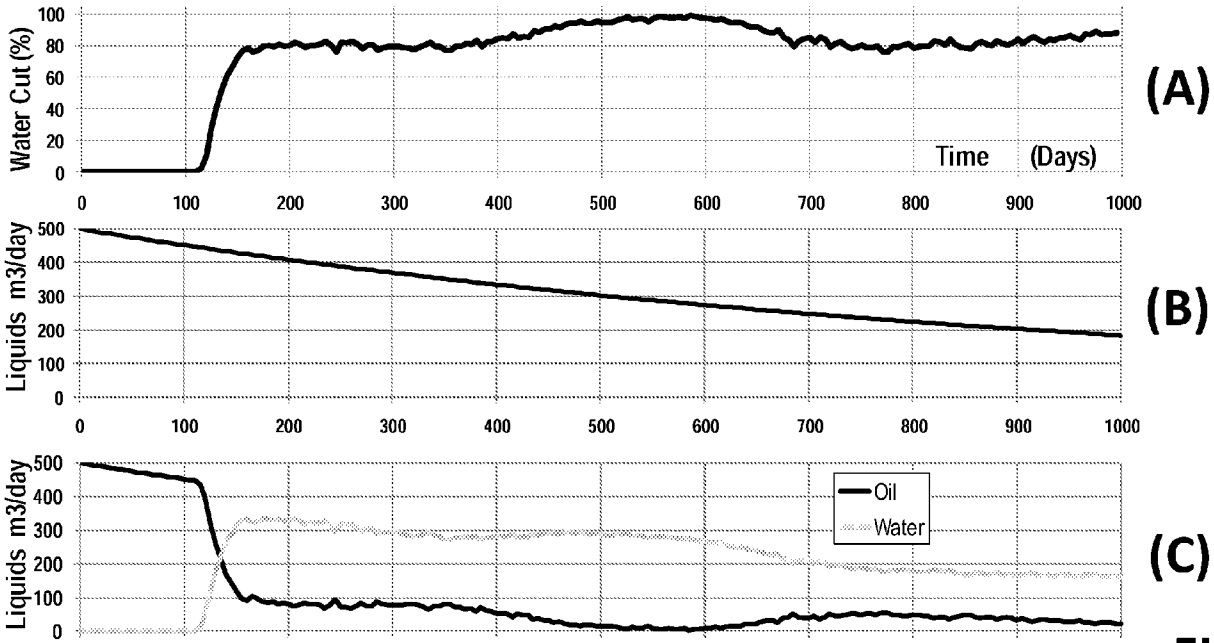
FIG. 23A shows a water cut curve resulted from simulation using the model of FIG. 22. The calculated water cut curves closely resemble that shown in FIG. 19A.
FIG. 23B shows a production rate as a function of time based on simulation of the model of FIG. 22. This flow rate curve closely resembles that shown in FIG. 19B.
FIG. 23C shows the production curves of oil and water, respectively, according to simulation of the model of FIG. 22.

FIG. 23A shows the water cut curve obtained with this model over 1000 days, averaged over 25 simulation runs. Combining the water cut curve (FIG. 23A) with the production flow rate curve (FIG. 23B) directly provides the oil and water flow rates shown in the bottom plot (FIG. 23C).

Recovery Factor and Enhanced Recovery for Karst Systems

It is interesting to note that even in cave systems where free flow dominates, recovery factors can be quite poor. The recovery factor depends dramatically on the geometry of the caves. Oil is trapped in pockets located at the ceiling of the structures. Therefore, it is possible to have cave systems where 90% or more of the oil is non-producible under natural flow.

In these situations, enhanced recovery can be achieved, for example, by injecting gas (such as nitrogen or $CO_2$) into the cave systems. Due to buoyancy, the injected gas will replace the oil trapped in ceiling pockets and push it towards the producing well. Gas injectors with optimized locations may allow for recovery of most oil in a cave system.

In the example of Case Study 1, CH4 is an obvious location for a gas injector. All the oil remaining in the cave CH4 and all the oil in the oil trap OT1 may be recovered by gas injection into CH4. However, the oil remaining in the cave chambers CH2/CH3 may not be recovered with the same gas injector. In deep karst reservoirs, nitrogen may be injected in the form of water/nitrogen foam in order to have a sufficient density of the injected fluid to limit the surface pressure to safe values.

A dynamic simulation of nitrogen foam injection can be done with the CA simulator described here to predict the enhanced recovery.

Case Study 2

Figure 24A:
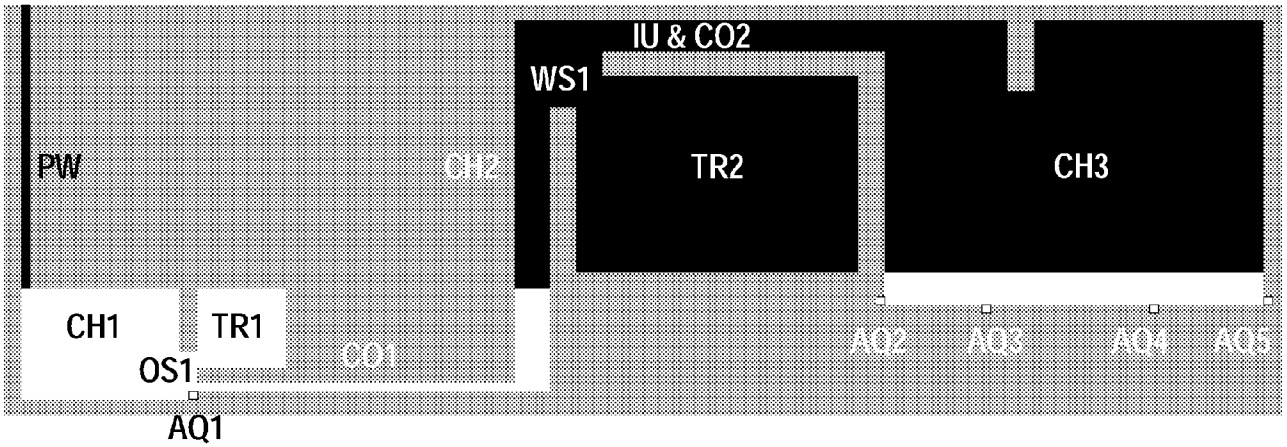
FIG. 24A shows another model of another karst system including a flow splitter and a fluid trap in accordance with one embodiment of the invention.
Figure 24B:
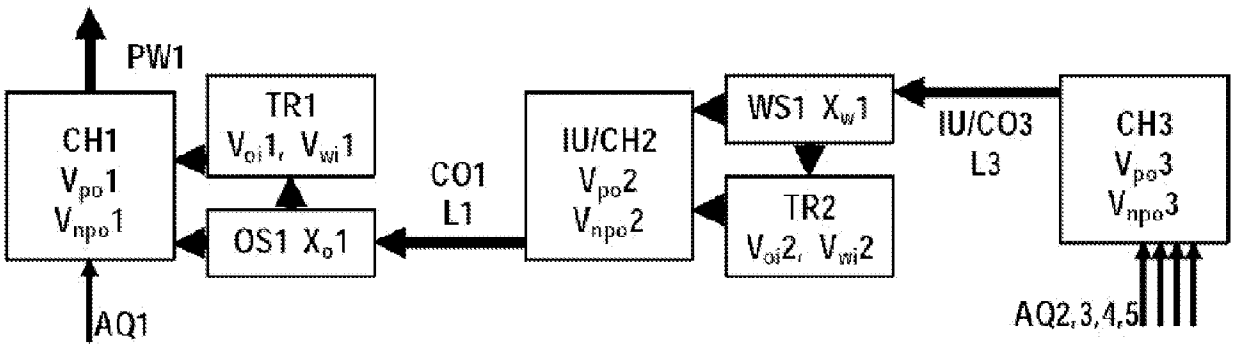
FIG. 24B shows a symbolic representation of the model of FIG. 24A in accordance with one embodiment of the invention.

Case study 1 had a well starting with dry oil production and increasing water cuts, followed by decreased water cut. Case study 2 is the opposite; production starts with a high water content, and then water cut is reduced. The water cut increases again a couple years after the production start time. A cave system model for Case Study 2 is shown in FIGS. 24A and 24B.

This model is very similar to the model shown in FIGS. 13 and 14. The maze of fractures may be replaced with a long conduit CO1. The size of the fluid trap TR1 was increased and an oil flow splitter OS1 was added at the entrance of cave chamber CH1. The effect of including an oil flow splitter and a bigger oil trap at the entrance of cave chamber 1 will be discussed and compared to simulations performed with the model in FIG. 13.

Figure 25:
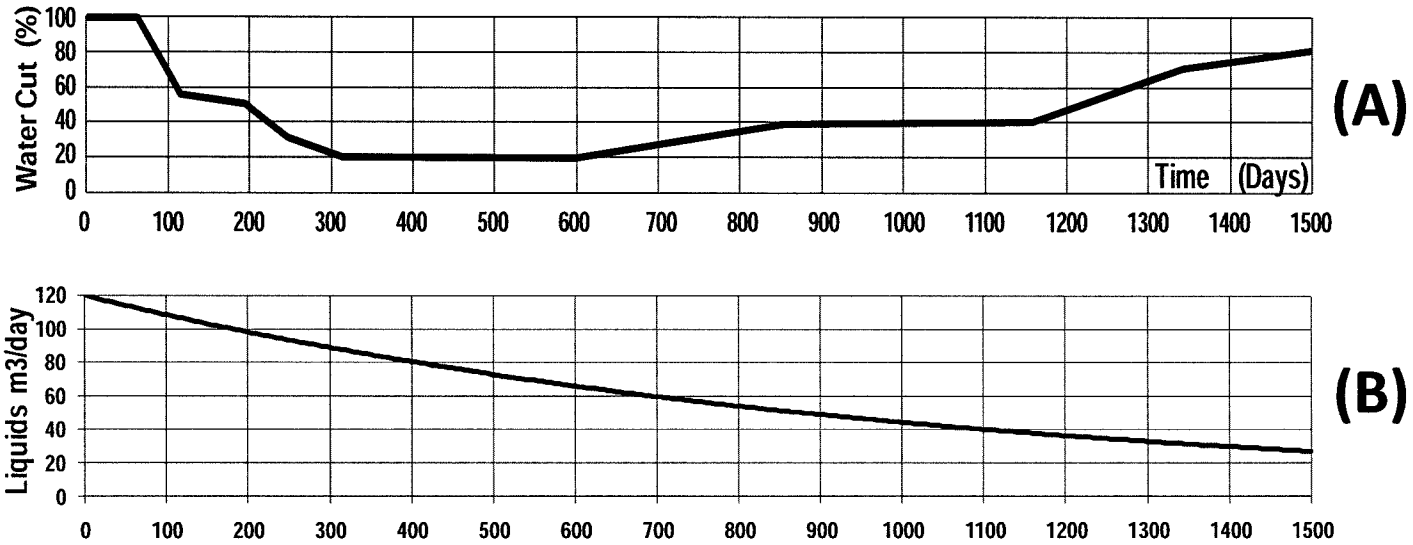
FIG. 25A and FIG. 25B show water cut curve and flow rate curve of the model of FIG. 24A or FIG. 24B in accordance with one embodiment of the invention.

The Case Study 2 is based on the production data shown in FIG. 25A. Five phases are clearly visible in this water cut curve.

Phase 1: 100% water production plateau from start to 60 days

Phase 2: rapid increase of oil production and plateau at about 50% water cut (60 to 200 days)

Phase 3: further decrease of water cut from 50% to a 20% water cut plateau (200 to 600 days)

Phase 4: increase of water cut from 20% to a 40% water cut plateau (600 to 1150 days)

Phase 5: gradual increase of water cut to 80% and more (1150 to 1500 days)

The decline curve shown in FIG. 25B is not an actual curve from the well, but a curve for the expected total liquid flow rates after removing the effects of various nozzle changes that were made during the four years of production.

This type of production behavior is almost never seen in conventional (i.e., non-cave system) reservoirs, where water production generally tends to increase over time and would not decrease, as shown in FIG. 25A.

Phase 1 is a clear indication that the production well is connected to a cave chamber CH1 that is full of water. This cave is likely to be at a lower level (perhaps lower than the general local oil-water-contact interface) than other nearby cave chambers containing oil.

Phase 3 has the lowest water cut production of all phases: 20%. Assuming the oil comes from a second oil cave that is connected to the water cave CH1, there is a ratio of 4:1 between the number of aquifer entry points in the oil cave and the other aquifer entry points in CH1 bringing water. This ratio is required to reach 20% water cut. Therefore, an aquifer entry point AQ1 is placed in CH1 and four aquifer entry points AQ2,3,4,5 are placed in the oil cave.

Although the water cuts in phases 1 and 3 are easier to understand, it is a bit more complicated in phase 2. Specifically, the question is why the water cut seems to have a small plateau around 50% in phase 2. This can be accounted for by including an oil trap and a flow splitter explained below.

When oil from the oil caves starts to reach CH1, it comes at a flow rate that is four times the water flow rate entering CH1 through AQ1. In order to have a plateau around 50%, it is necessary to reduce the oil flow rate reaching the production well PW. This can be achieved by splitting the oil flow with a flow splitter element OS1 and trapping 75% of the oil flow into an oil trap TR1.

When the oil trap is full, all the oil flow can then reach the production well PW, and the water cut stabilizes at a 20% water cut plateau, as observed in phase 3.

Similarly, it is necessary to include a water trap in the second cave, or on the way between the second cave CH2 and the first cave CH1, in order to explain the 40% water cut plateau in phase 4. When the water produced from the four aquifer entry points AQ2,3,4,5 reaches the top level of the cave chamber CH3, it goes to a water flow splitter WS1 and about 75% of the water goes into the trap TR2. The other 25% of the water, as well as the oil released from the trap TR2, flow to the production well PW. This is equivalent to having two aquifer entry points bring water to PW, and the other three aquifer entry points pushing oil out of trap TR2 to the well PW, hence the 40% water cut plateau.

Finally, when the trap TR2 is full of water, all the water is directed to PW, and the water cut gradually increases to 100% over time. It can take a long time, e.g. several years, before the mixed oil and water flow becomes a pure water flow.

Figure 26:
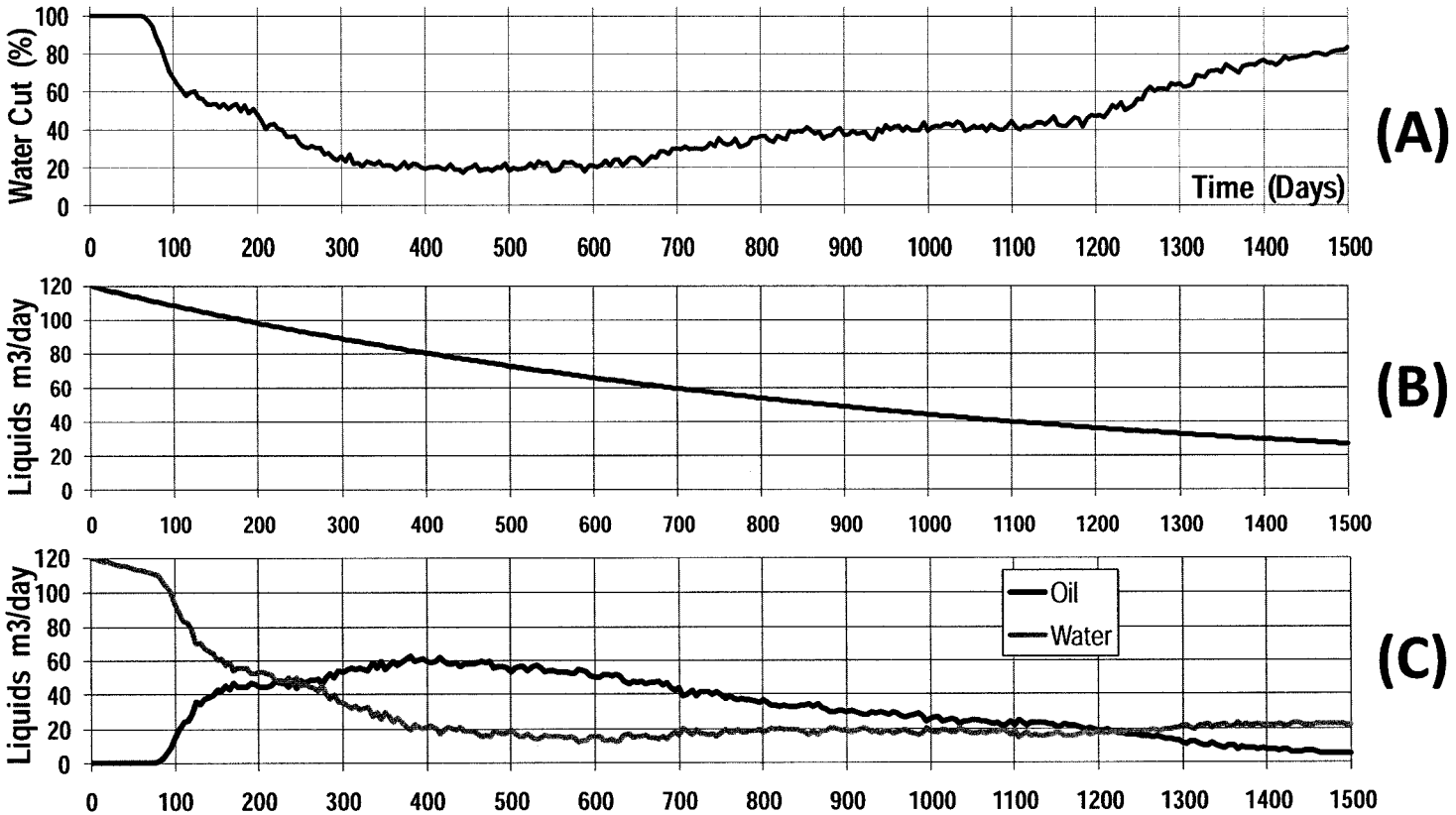
FIG. 26A and FIG. 26B show, respectively, water cut curve and flow rate curve as calculated based on the model of FIG. 24A. These curves closely resemble those of FIG. 25A and FIG. 25B, respectively.
FIG. 26C shows the production curves for oil and water according to the simulation in accordance with one embodiment of the invention.

FIG. 26A shows a water cut curve obtained with this model over 1500 days, averaged over 25 simulation runs. This simulated production curve closely mimics the actual production curve shown in FIG. 25A, illustrating the utility and power of a model and simulator of the invention.

FIG. 26B shows the flow rates over time. Again, this curve closely resembles that in FIG. 25B. Combining the water cut curve (FIG. 26A) with the production flow rate curve (FIG. 26B), one would have the oil and water flow rates shown in the bottom plot (FIG. 26C).

Figure 27:
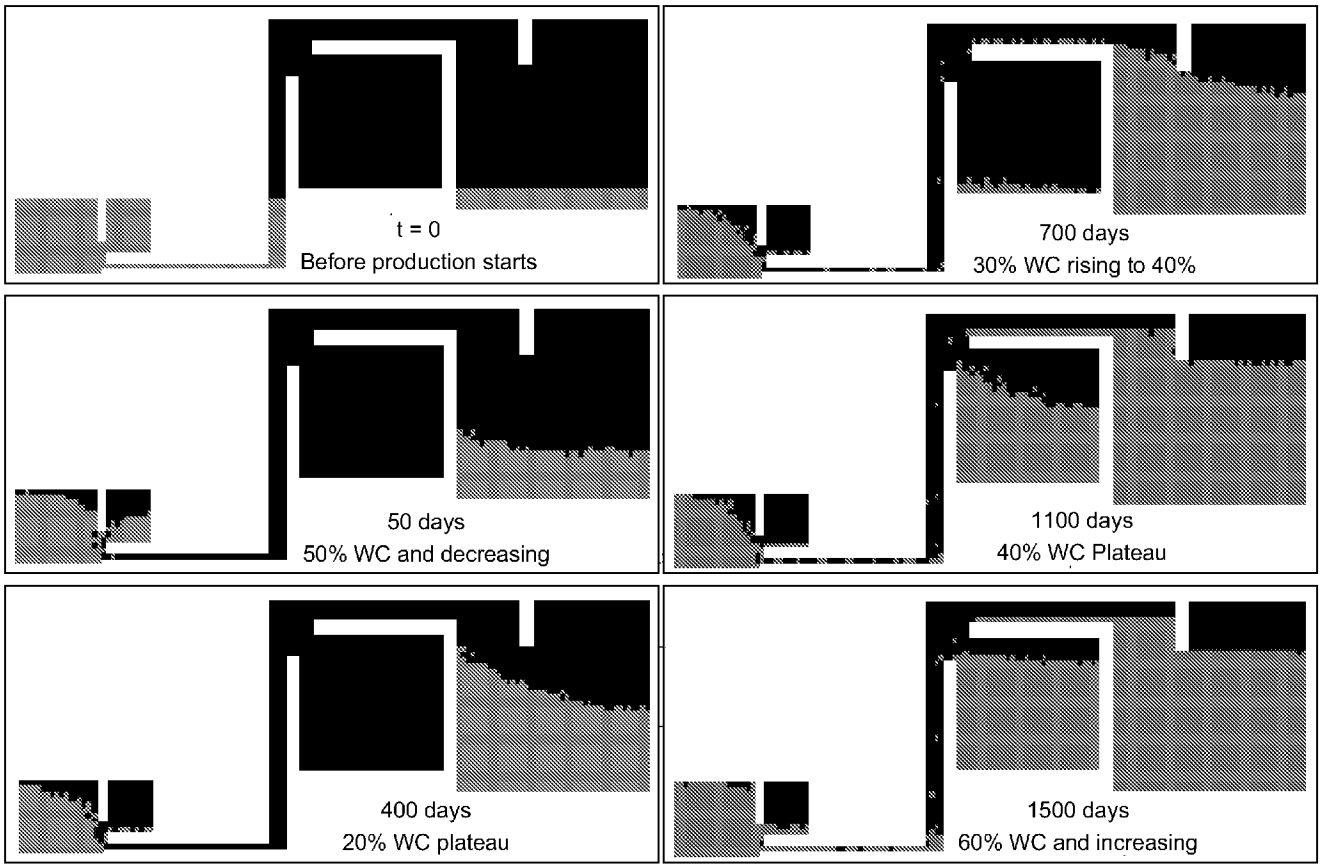
FIG. 27 shows a series of snap shots at various stages for the simulation of production of the model of FIG. 24A.

FIG. 27 shows a sequence of snapshots for the CA simulation of Case Study 2, illustrating various stages of cell movements. This representation can provide visual aids to help an operator understand the status of the reservoirs at various stages of the production.

Figure 28:
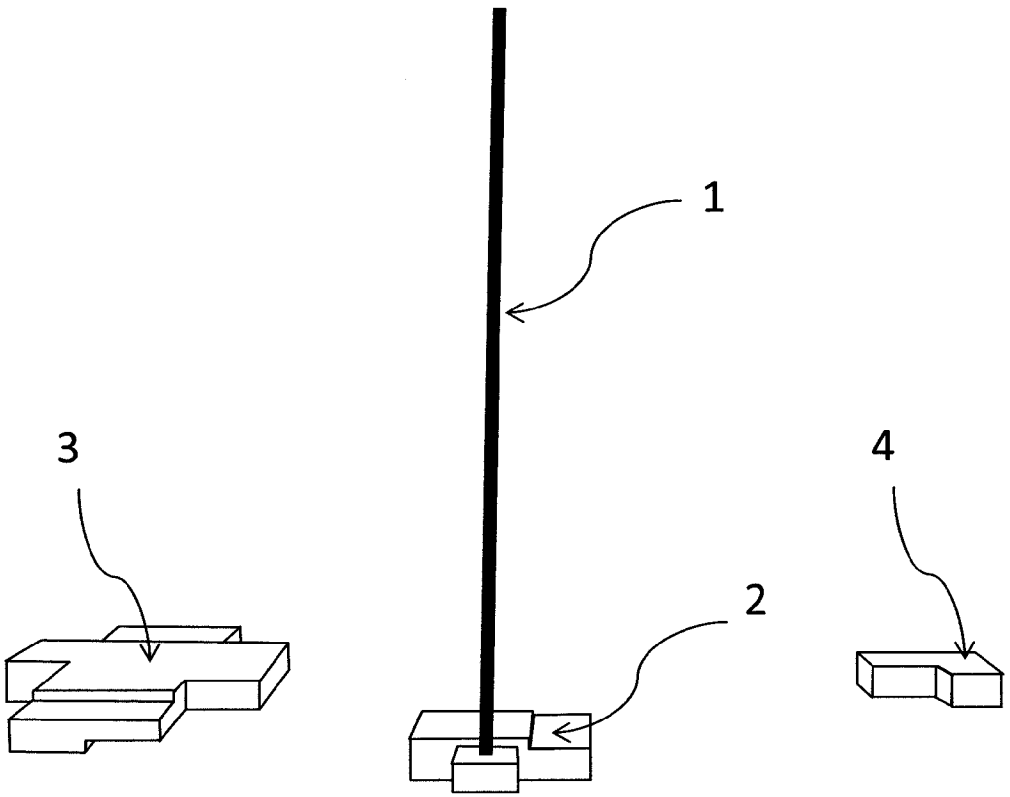
FIG. 28 shows a cave system as determined by seismic survey in the area that produced the production curve (water cut curve) shown in FIG. 26A.

As noted above, seismic techniques may be used to map cave structures underground. These techniques can be very useful in helping to build cave systems. FIG. 28 shows a cave system determined with seismic survey in the area that produce the production curve (specifically, the water cut curve) used in Case Study 2. As shown in FIG. 28, seismic survey reveals a cave system in this area containing three caves 2, 3, and 4 and a producer well 1 reaching cave 2.

Note that the model in Case Study 2 (shown in FIG. 24A) is derived from the interpretation of production data, more precisely from the interpretation of the water cut curve versus time (FIG. 25A). The cave system model shown in FIG. 24A contains two main caves: a water cave and an oil cave. The seismic data confirms the presence of these two caves. The water cave 2 observed on the seismic data is located at a lower level compared to the oil cave 3. This confirms the validity of the cave system model shown in FIG. 24A.

However, seismic survey reveals an additional cave, Cave 4, which is not present in the model derived from the production data. Most likely, this is due to the fact that Cave 4 is not connected to the production well 1, and, therefore, does not contribute to the production data. If Cave 4 does not contribute to the production data, then it would not appear in the model that is based on the production data.

While seismic techniques are useful in mapping cave structures, it does not have sufficient resolution to visualize details, such as smaller caves or conduits connecting the caves. Such smaller structures can be inferred from production data or determined using other well logging techniques, such as well testing or interference test data. The integration of seismic data, as well as well testing and interference test data, is a very useful step to validate the cave system model.

Figure 29:
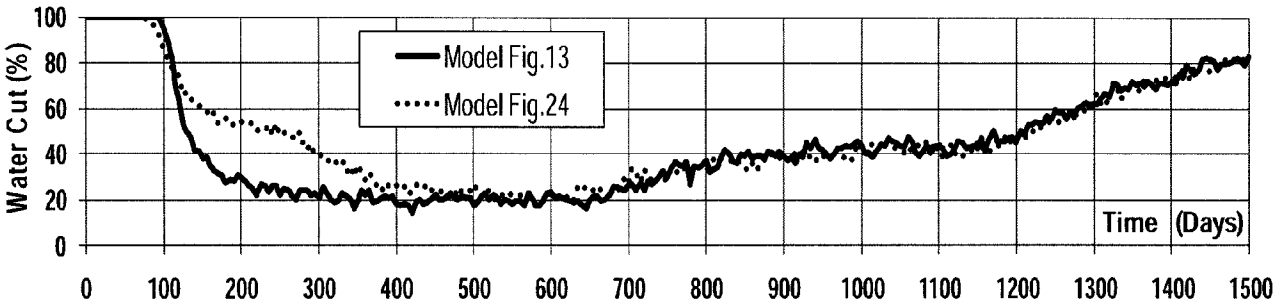
FIG. 29 shows a chart comparing the production curves of the model of FIG. 13 versus that of FIG. 24A.

A comparison between the two water cut curves obtained with the CA simulator for the model shown in FIG. 13 and the model of FIG. 24A (Case study 2) is shown in FIG. 29. The oil reaches the production well PW with a slight delay in model of FIG. 13 because of the volume of cave chamber CH2. The effect of the oil trap and oil slow splitter is clearly visible in the model of FIG. 24A, with a water cut level hanging around 50% during a period of a couple months. The remaining part of the curves is very similar, except for the expected statistical fluctuations. This comparison allows one to calculate that approximately 1000 cubic meter of oil was trapped in the oil trap TR1.

While the examples above illustrate simulation of two-phase systems (water and oil), embodiments of the invention can be used to simulate multiphase karst systems (i.e., including 2 or more phases, such as water, oil, and gas). The following example illustrates the rules that can be used to simulate 3-phase flow with a CA simulator.

2-D Cellular Automata Rules for Free Gas

Figure 30:
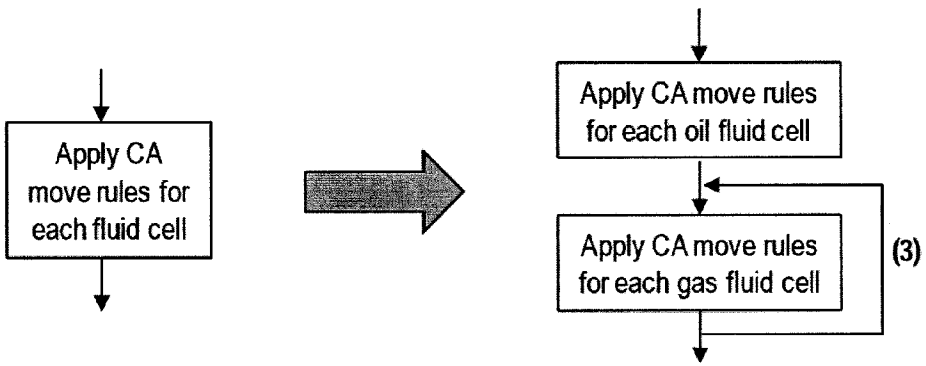
FIG. 30 shows a modification to the flowchart of FIG. 18 in order to take into account of gas movement in the system in accordance with one embodiment of the invention.

As noted above in the section entitled, "CA Rules for Cell Moves," free gas cells move up faster than oil cells due to higher buoyancy. In accordance with embodiments of the invention, the relative moving velocities of gas and fluid can be adjusted. A typical velocity ratio in high pressure reservoirs is about 3:1 (gas:liquid). In such a three-phase CA simulator (water, oil, and free gas), one should replace the box "Apply CA move rules for each cell" in FIG. 18 with a sequence shown below with a loop for the free gas cells in order to account for the faster upward velocity of gas, e.g. 3 times (for a velocity ratio of 3, or any other suitable factor to account for the relative velocities), as illustrated in FIG. 30.

Figure 31:
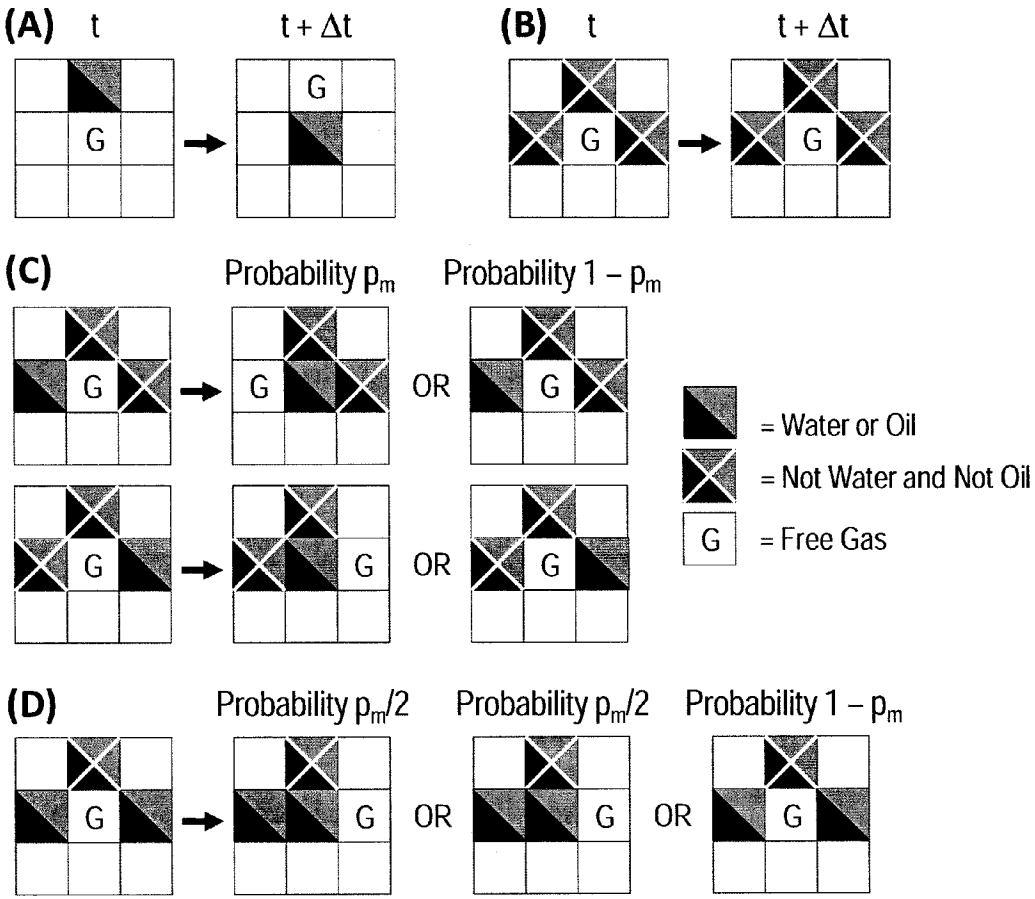
FIGS. 31A-31D show graphical representation of cell movements involving gas phase in accordance with one embodiment of the invention.

FIG. 31 graphically illustrates an example of CA rules that can be added to the previous set of rules to account for free gas cells. Briefly, the rules may be summarized as follows:

- If an oil/water cell is above a gas cell, the cells will swap the positions after the move (Scenario A).
- If the gas cell is surrounded by cells that do not contain water or oil, the gas cell would not move (Scenario B).
- If the gas cell is next to an oil or water cell to one side (left or right) and the probability of the gas cell swapping with the oil or water cell is Pm, then after a simulation step ($\Delta t$), the swapping would take place with that probability (Pm) and the cells would not swap with a probability of (1-Pm) (Scenario C).
- If the gas cell is neighbored by two oil/water cells (on both left and right sides) and the probability for the gas cell to swap with one of it neighbor is Pm, then after a simulation step ($\Delta t$), the gas cell may swap with either the right or left cell with a probability of Pm/2, while no swapping will occur with a probability of (1-Pm) (Scenario D).

Embodiments of the invention for the simulation of karst systems can be implemented with any suitable software, including but not limited to ECLIPE (from Schlumberger Corporation, Houston, Tex.), which contains a suite of software packages for various reservoir simulations. The following example illustrates a simulation using ECLIPSE.

Example of Implementation of a 2-D Multi-Phase Karst Simulator Using ECLIPSE

Figure 32A:
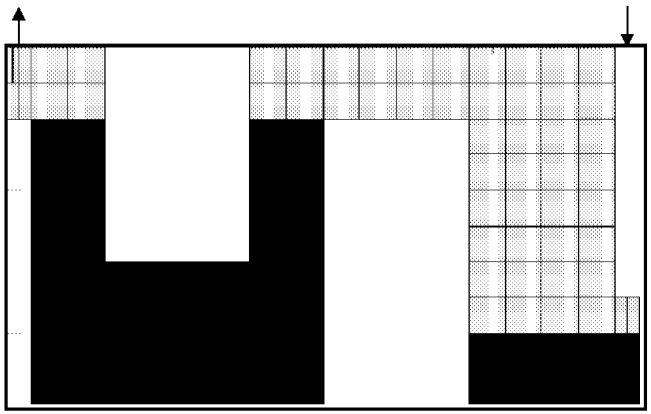
FIGS. 32A-32C show various states during simulation of a model of a siphon to illustrate an alternative implementation using ECLIPSE to model fluid movement in accordance with one embodiment of the invention.
Figure 32B:
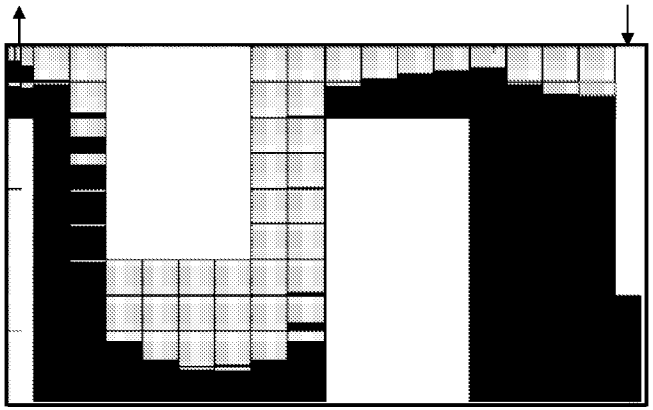
Figure 32C:
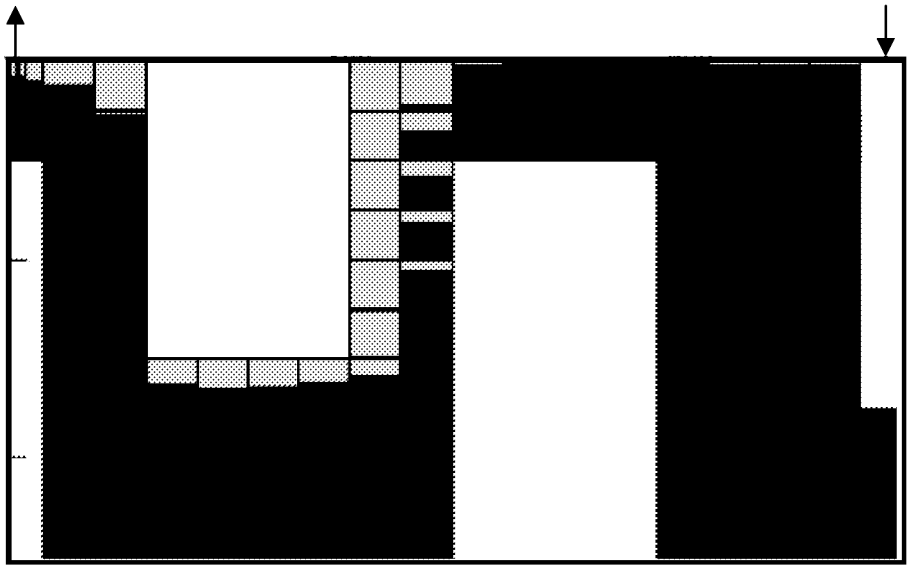

As noted above, fluid flows in cave systems (karst systems) are more like free flows. Free flow can be simulated using standard ECLIPSE software (using the VE module). The example shown in FIGS. 32A-32C illustrates fluid flow in a siphon model. This siphon model is a 2D model. It can be easily expanded to handle 3-D geometries. Similarly, cave (karst) system models in accordance with embodiments of the invention (see Examples of Case Studies 1 and 2) may be implemented in 2D or 3D.

Figure 33:
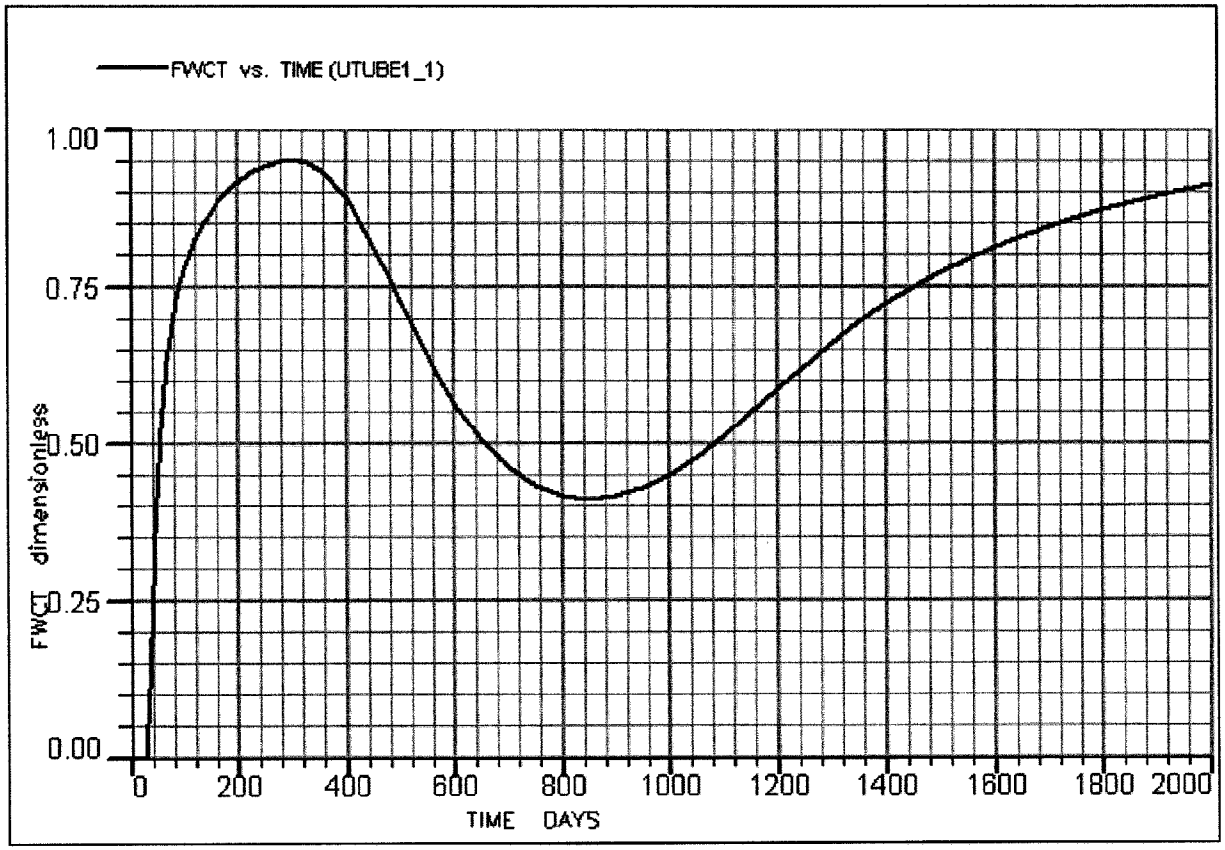
FIG. 33 shows water cut during production of the siphon model of FIG. 31.

FIG. 32A shows the siphon system at the beginning of flow. An outlet (e.g., a production well PW) is illustrated as an arrow at the upper left corner, while an inlet (e.g., an aquifer for supplying replacement fluids) is located at the lower right corner. As fluid is withdrawn from the outlet, replacement fluid will come in to fill the void. FIG. 32B shows an intermediate state after some oil has been produced. FIG. 32C shows a later state when most oil has been produced. The water cut at the output of the production well for this example can also be calculated, as shown in FIG. 33.

Figure 34:
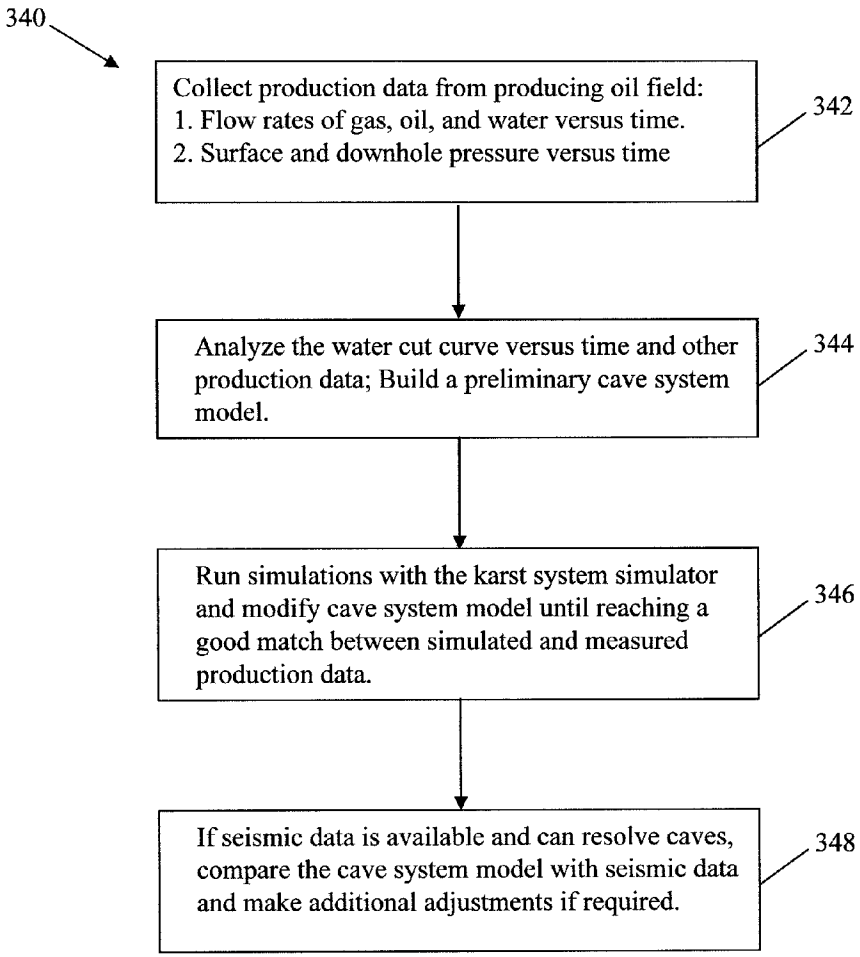
FIG. 34 shows a flow chart illustrating a method for simulating a cave system based on production data and other well data in accordance with one embodiment of the invention.

As noted above, methods of the invention may be used to model a karst system based on production data. FIG. 34 shows a flow chart, illustrating a method for modeling a cave system based on production and other well logging data in accordance with one embodiment of the invention. As shown in FIG. 34, a method of the invention 340 may include a step 342 of collecting production data from producing oil field. Such data may include flow rates of gas, oil, and water versus time, as well as data for surface and downhole pressure versus time.

The method next analyzes the water cut curve versus time and other production data to build a preliminary cave system model (step 344). Then, the method runs simulations with a karst system simulator of the invention and modify cave system model until reaching a good match between simulated and measured production data (step 346).

If seismic data is available and can resolve caves, compare the cave system model obtained in step 346 with seismic data and make additional adjustments if necessary (step 348).

As illustrated above, a multi-phasic dynamic simulator for a karst system of the invention may be implemented with any suitable computation systems, including a personal computer (see e.g., FIG. 35) with a commercial software package as simple as EXCEL (Microsoft, Redmond, Wash., USA).

Figure 35:
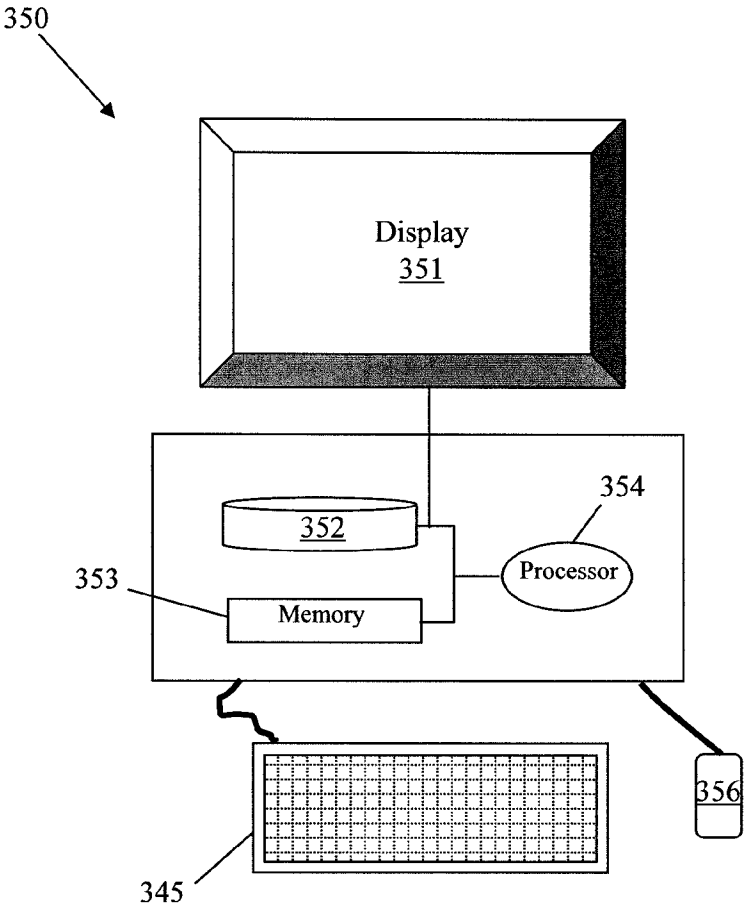
FIG. 35 shows a convention personal computer that can be used to implement embodiments of the invention.

As shown in FIG. 35, a personal computer 350 may include a display 351, a processor 354, a storage device (such as a hard drive) 352, a memory 353, one or more input devices (such as a key board 355 and a mouse 356).

Alternatively, the multi-phasic dynamic simulator for kart systems may be implemented as part of a software or systems that are designed for oil and gas industry, such as the ECLIPSE system from Schlumberger Technology Corporation (Houston, Tex., USA).

In addition, some embodiments of the invention may relate to a computer readable media that stores a program having instructions to cause a processor to execute steps for implementing one or more methods of the invention. Such computer readable devices, for example, may include a hard drive, a floppy disk, a CD, a DVD, a tape, etc.

Advantages of embodiments of the invention may include one or more of the following. A multi-phasic dynamic simulator of the invention can be used to model and predict flow behaviors and production data in cave systems. A model of a karst system in accordance with embodiments of the invention can be represented with simple chambers (caves) with conduits (channels or fractures) and various traps and/or flow splitters. These simple models are easier to visualize the cave systems and yet they can predict flow behaviors in the cave systems with accuracy. A multi-phasic dynamic simulator of the invention can also be used in a reverse manner to aid the understanding of a cave system based on actual production date. Embodiments of the invention are simple to implement, and yet they can produce accuracy simulation results.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A multi-phasic dynamic reservoir simulator, comprising:

a memory that stores a program and stores a reservoir model for a karst system, the reservoir model comprising:

a plurality of caves connected via at least one conduit, wherein the plurality of caves and the at least one conduit are filled with at least two types of fluids, an exit point for a fluid to leave the karst system and at least one entry point for a fluid to enter the karst system from a surrounding rock matrix, and a set of parameters defining volumes and distributions of the at least two types of fluids in the plurality of caves and the at least one conduit, and wherein a volume of the plurality of caves is divided into a plurality of cells;

wherein the plurality of cells comprises: fluids cells and non-fluids cells;

and a processor that, by executing the program stored on the memory performs a simulate fluid flow simulation based on the reservoir model for the karst system, wherein the fluid flow simulation comprises:

selecting a fluid cell from the plurality of cells; and moving the selected fluid cell to another cell based on movement rules for the selected fluid cell.

2. The simulator of claim 1, wherein the at least two types of fluids comprise at least two liquid phases and one gas phase.

3. The simulator of claim 1, wherein the reservoir model comprises a two-dimensional representation of the karst system.

4. The simulator of claim 1, wherein the reservoir model comprises a three-dimensional representation of the karst system.

5. The simulator of claim 1, wherein the reservoir model further comprises a fluid trap.

6. The simulator of claim 5, wherein the reservoir model further comprises a flow splitter connected to the fluid trap.

7. The simulator of claim 1, wherein the program further comprising instructions for causing the processor to simulate a production rate as a function of time for each of the at least two types of fluids from the at least one exit.

8. The simulator of claim 1, wherein the program further comprises instructions for varying a set of parameters defining the karst system in the reservoir model such that the simulator is capable of reconstructing a cave system based on production data.

9. The simulator of claim 1, wherein a position of the exit point in the karst system can be changed such that a position for a production well in the karst system can be determined to maximize production of a fluid.

10. The simulator of claim 1, wherein the reservoir model further comprises an entry point for an injection well, a location of which can be changed to maximize recovery of a fluid by injection of a gas.

11. The simulator of claim 1, wherein the reservoir model takes into account of actual geomorphology of the plurality of caves to simulate trapping of fluids due to structural traps.

12. A method for simulating fluid behavior in a karst system using a multi-phasic dynamic reservoir simulator, comprising:

constructing a reservoir model for the karst system, wherein the reservoir model comprises:

a plurality of caves connected via at least one conduit, wherein the plurality of caves and the at least one conduit are filled with at least two types of fluids, an exit point for a fluid to leave the karst system and at least one entry point for a fluid to enter the karst system from a surrounding rock matrix, and a set of parameters defining volumes and distributions of the at least two types of fluids in the plurality of caves and the at least one conduit, wherein a volume of the plurality of caves is divided into a plurality of cells;

wherein the plurality of cells comprises: fluids cells and non-fluids cells;

storing the reservoir model in a memory; and simulating, by a processor operatively coupled to the memory, fluid flow in the reservoir model for the karst system, wherein simulating the fluid flow by the processor further comprises:

selecting a fluid cell from the plurality of cells; and determining a movement of the selected fluid cell to another cell based on movement rules for the selected fluid cell.

13. The method of claim 12, wherein the at least two types of fluids comprise at least two liquid phases and one gas phase.

14. The method of claim 12, wherein the reservoir model further comprises one or more hydraulic elements selected from the group consisting of a cave chamber, a conduit, a siphon, a fluid trap, a flow splitter, and an aquifer entry point.

15. The method of claim 14, wherein the model of the cave system is derived from interpretation of a water cut curve versus time measured in a field.

16. The method of claim 12, further comprising simulating a production rate as a function of time for each of the at least two types of fluids from the at least one exit.

17. The method of claim 12, further comprises varying a set of parameters defining the karst system in the reservoir model to reconstruct a cave system based on production data.

18. The method of claim 12, further comprising varying a position of the exit point in the karst system to maximize production of a fluid.

19. The method of claim 12, further comprising simulating injection of a gas at an entry point in the karst system to maximize recovery of a fluid.

20. The method of claim 12, wherein the reservoir model takes into account of actual geomorphology of the plurality of caves to simulate trapping of fluids due to structural traps.

21. The method of claim 12, further comprising validating the reservoir model using seismic data.

22. A non-transitory computer readable medium storing instructions that, when executed by a processor, cause the processor to:

simulate fluid flow in a reservoir model for a karst system, wherein the reservoir model for the karst system comprises:

a plurality of caves connected via at least one conduit, wherein the plurality of caves and the at least one conduit are filled with at least two types of fluids, an exit point for a fluid to leave the karst system and at least one entry point for a fluid to enter the karst system from a surrounding rock matrix, and a set of parameters defining volumes and distributions of the at least two types of fluids in the plurality of caves and the at least one conduit, wherein a volume of the plurality of caves is divided into a plurality of cells;

wherein the plurality of cells comprises: fluids cells and non-fluids cells;

and wherein simulating the fluid flow by the processor further comprises:

selecting a fluid cell from a plurality of cells;

and determining a movement of the selected fluid cell to another cell based on movement rules for the selected fluid cell.

* * * * *